US006312325B1

(12) United States Patent
Van Osenbruggen

(10) Patent No.: US 6,312,325 B1
(45) Date of Patent: Nov. 6, 2001

(54) SANDING DISKS

(75) Inventor: Anthony Alfred Van Osenbruggen, Auckland (NZ)

(73) Assignee: Norton Company, Worcester, MA (US)

( * ) Notice: Subject to any disclaimer, the term of this patent is extended or adjusted under 35 U.S.C. 154(b) by 0 days.

(21) Appl. No.: 09/498,427

(22) Filed: Feb. 4, 2000

(30) Foreign Application Priority Data

| | | |
|---|---|---|
| Dec. 8, 1995 | (NZ) | 280634 |
| Dec. 19, 1995 | (NZ) | 280710 |
| Jan. 4, 1996 | (NZ) | 280781 |
| Jan. 23, 1996 | (NZ) | 280876 |
| Feb. 9, 1996 | (NZ) | 280964 |

(51) Int. Cl.[7] ..... B23F 21/03

(52) U.S. Cl. ..... 451/548; 451/449; 451/488; 528/532

(58) Field of Search ..... 451/548, 526, 451/539, 540, 550, 527, 528, 529, 532, 449, 456, 488

(56) References Cited

U.S. PATENT DOCUMENTS

| | | | | |
|---|---|---|---|---|
| 3,191,351 | * | 6/1965 | Balz | 451/508 |
| 4,021,969 | * | 5/1977 | Davis | 451/6 |
| 5,605,501 | * | 2/1997 | Wiand | 451/526 |
| 5,697,359 | * | 12/1997 | Okanishi | 451/449 |
| 6,007,415 | * | 12/1999 | Van Osenbruggen | 451/488 |
| 6,077,156 | * | 6/2000 | Amin | 451/548 |
| 6,159,089 | * | 12/2000 | Amin | 451/548 |
| 6,203,416 | * | 3/2001 | Mizuno | 451/548 |

FOREIGN PATENT DOCUMENTS

| | | | | |
|---|---|---|---|---|
| 48112 | * | 12/1981 | (FR) | 451/548 |
| 48811 | * | 11/1988 | (JP) | 451/548 |
| 49207 | * | 7/1992 | (JP) | 451/548 |

* cited by examiner

*Primary Examiner*—Joseph J. Hail, III
*Assistant Examiner*—Daniel Shanley
(74) *Attorney, Agent, or Firm*—David Bennett

(57) ABSTRACT

Accessories for an angle grinder include a disposable rotary sanding disk having quite large shaped ventilating/viewing apertures, for use with a resilient backing plate also having shaped ventilating apertures. The apertures of one or both parts are shaped so that snagging of the apertures on projections from the work surface is minimized and to facilitate air flow across the work surface during use. This air flow helps in cooling the work and ejecting detritus, so minimising clogging effects. The ventilating apertures also facilitate viewing the work to be sanded through the spinning disk during the abrasion process, so that operator feedback is immediate. The holes also give the sanding disk more resilience so that a greater area comes in contact with the work and the disk wears more evenly over its abrasive surface.

9 Claims, 14 Drawing Sheets

Fig 1
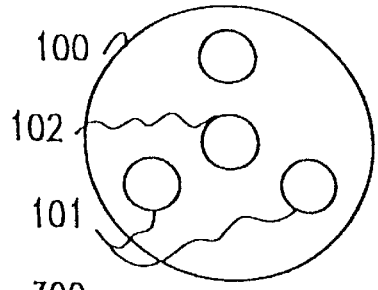
Fig 2
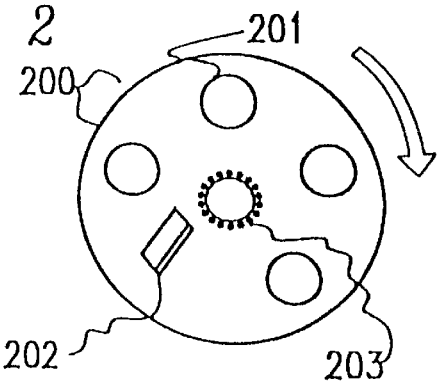
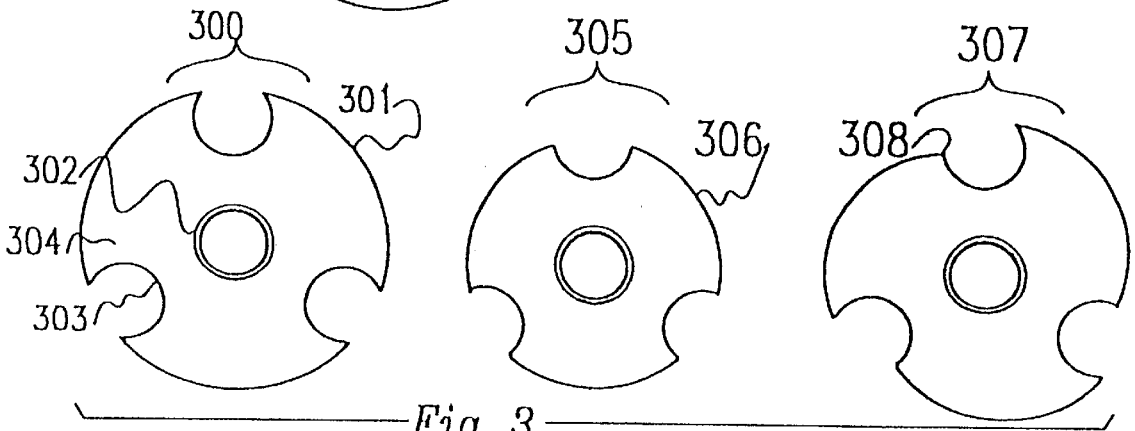
Fig 3
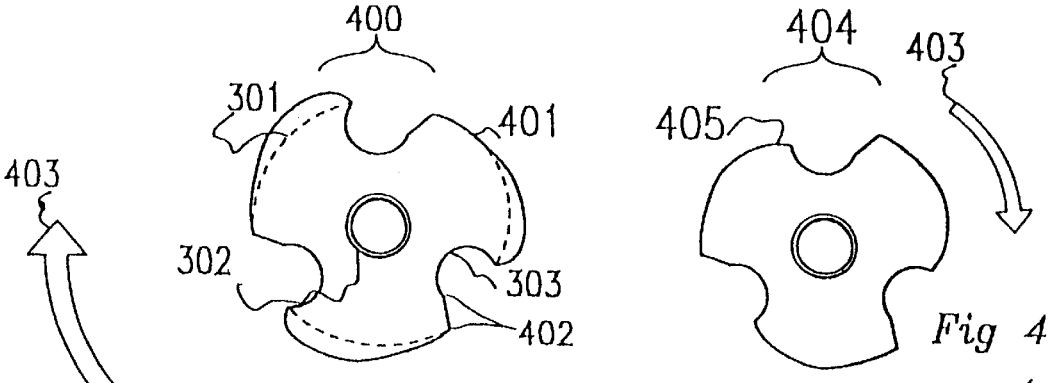
Fig 4
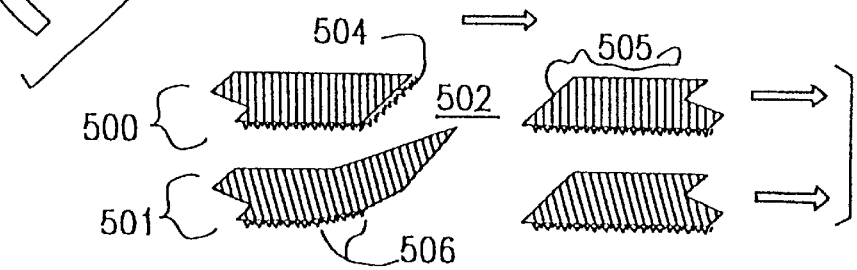
Fig 5

Fig 11
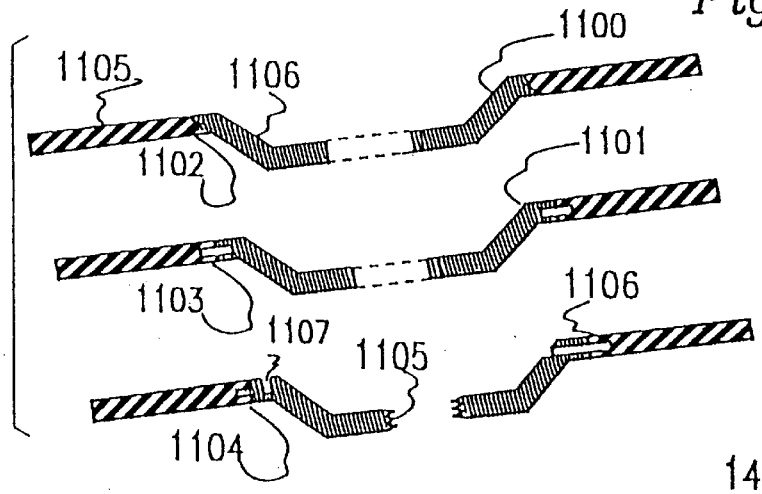
Fig 12
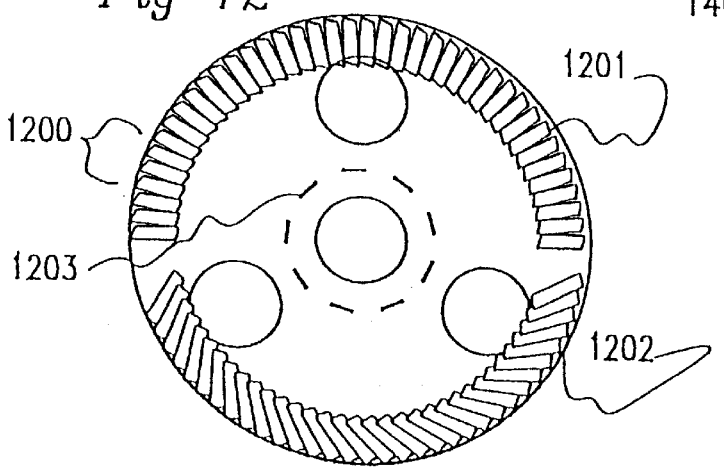
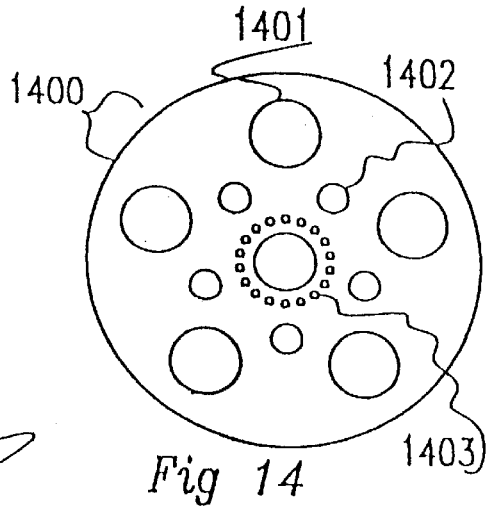
Fig 14
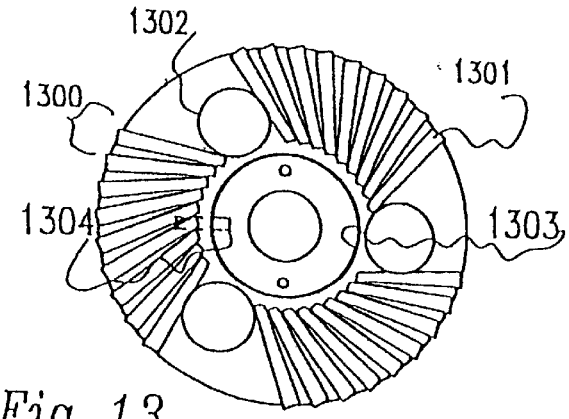
Fig 13
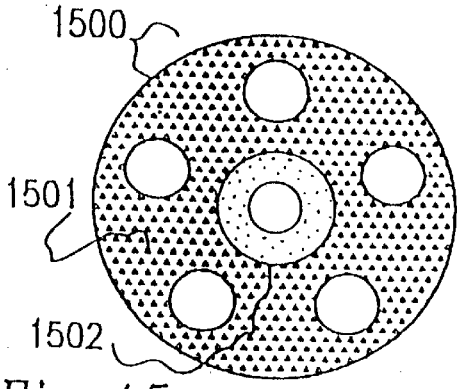
Fig 15

SANDING DISKS

TECHNICAL FIELD OF THE INVENTION

This invention relates to the field of abrasive or sanding disks, and in particular this invention relates to sanding disks and accessories for angle grinders and means for making them.

BACKGROUND

Abrasive disks, or sanding disks are widely used on portable electric drills and (at a more professional level) on hand-held angle grinders. When used on these machines the disk is held by its centre against a backing pad and is rotated at generally a high speed while pressed in front of a backing plate against the work. The abrasive surface wears down the surface of the work by, in effect, a cutting action. Angle-grinder mounted sanding disks are commonly used (for example) in automotive panel beating, where body filler is to be sanded back to conform to the original contours of a remodelled car part. It is said that millions of sanding disks suitable for use with angle grinders are sold each year. There are some problems related to the use of sanding disks, such as:

(a) The relatively rigid backing disks commonly used with angle grinder sanding disks force the sanding disks into an unsatisfactory mode of operation when the angle grinder is tilted towards the work during use—such as that primarily the edge engages with the work resulting in local, intense action rather than an even, gradual action over a wider area. There is a tendency for the work surface to develop an unsatisfactory scalloped surface which requires hand sanding block treatment. The disks cannot be used for finely controlled work such as preparation of surfaces in a state ready for painting.

(b) Sometimes the material being abraded tends to melt at the high cutting speeds involved, and if this happens it is particularly likely to clog the sanding disk in a quick and effective manner so that the disk has to be discarded. Melting may also lead to the tool biting in and as a result the surface of the work may be inadvertently destroyed. Heating also adversely affects the life of the sanding disk.

(c) The operator cannot see the material being sanded during the actual operation; he/she can only see material that is not covered by the blade. It is difficult to carry out a precise operation without repeatedly inspecting the work in progress and more closely reaching an approximation to the desired result. Hand-held tools cannot be re-applied precisely so that repeated inspection is not a good option for careful work.

It is a well known phenomenon that a disk having perforations becomes semi-transparent when spun at a moderate to high speed because of the persistence of image on the retina in the human eye—the "persistence of vision" effect. The image seen through a perforated spinning disk is further enhanced if there is a contrast in light and/or colour between the spinning disk and its background and/or foreground. To increase the width of the "window" or see-through viewing effect when a disk is spun, perforations are usually designed to overlay each other. There are many abrasive and rasping disks that make use of this phenomenon. Examples are those of F. Reidenback filed Aug. 31, 1953 U.S. Pat. No. 2,749,681 or J. C. Schwartz filed Mar. 26, 1985 U.S. Pat. No. 4,685,181.

Because of the presumed catastrophic consequences of protrusions into large apertures of perforated disks these inventions to date have relied on using many small perforations in the disk in relation to total disk size.

DEFINITIONS & NOTES

Although we relate the invention to angle grinders in particular, the invention is also applicable to sanding disks used in some other power tools, such as ordinary electric drills, even though the usual types of electric drills do not spin at such a high speed.

"Aperture" means a channel or hole passing completely through an object, and is surrounded on all sides by the material of the object. It is not limited to apertures having a circular profile.

"Dished" means that a disk has been formed into a convex shape (like a saucer) and for this invention the abrasive would usually be found on the base, or convex side, of the saucer.

"Disk" refers to a flat piece of relatively rigid material (though having some resilience) which is adapted for mounting on a rotatable spindle or arbor. It is not limited here to purely circular shapes. It includes materials adapted for use with an angle grinder in conjunction with a backing plate.

"Gap" means an indentation or invagination which is incompletely surrounded by the material of the object. It would include therefore configurations in which the circular periphery of a disk has had a segment, (defined below), removed or the configuration obtained by (notionally) moving an "aperture" until a portion extended beyond the periphery of the disk.

"Sanding" is used herein to refer to any abrading or finishing operation in which the surface of a workpiece is treated to remove material or alter the roughness.

"Segment" means that portion of a circle which lies between the perimeter and a chord.

STATEMENT OF THE INVENTION

In a first broad aspect the invention comprises a sanding system for use with an angle grinder or the like, comprising a disk bearing at least one abrasive surface, the disk being adapted for mounting upon an arbor of the angle grinder in conjunction with a matching backing plate, characterized in that the sanding disk is modified by being provided with at least one non-concentric aperture adapted for viewing and ventilation which aperture is capable in use of being substantially in alignment with at least one similarly adapted viewing and ventilation gap or aperture constructed within the backing plate, so that in use the work surface and the sanding disk are cooler as a result of air movement, abraded material is moved tangentially away, and the user can see the work through the at least one non-concentric apertures.

The term "non-concentric" as applied to apertures in this Application means that the aperture is displaced from the axis of rotation along a radius of the disk. A preferred number of non-concentric apertures adapted for viewing and ventilation is between one and nine.

A more preferred number of non-concentric apertures is between three and five.

Preferably the non-concentric apertures adapted for viewing and ventilation are placed at varying distances from the centre of rotation of the sanding disk, so that when the disk is rotated, a substantial proportion of the area beneath the disk can be seen. Rotation of the disk defines leading and trailing edges of the apertures and it is a feature of this invention that the trailing edge of each aperture is displaced out of the plane of the abrading surface of the disk and towards the back of the disk. This has the effect of minimizing the risk that protrusions from the surface being abraded will catch on the edge of the disk and cause rupture of the disk.

In a subsidiary aspect the shaping comprises raking at least the leading side, and optionally also the trailing side of the or each non-concentric aperture adapted for viewing and ventilation, thereby providing at least one slanting side to the or each aperture. This is only possible when the abrasive disks have significant thickness.

The distortion of the material surrounding the aperture so as to lift the material away from the working surface on the intended trailing edge, may also be effective is causing air turbulence enhancing the removal of swarf from the surface being abraded.

The invention also comprises a sanding disk as described previously, in which at least one edge of the or each non-concentric aperture adapted for viewing and ventilation is formed in order to serve as a cutting edge.

In a further aspect the viewing or ventilation apertures may also be regarded as means to intermittently interrupt the abrading action of the disk as it turns, thereby providing a "rest time" during which time the work surface may become cooler.

In another aspect the sanding disk as described previously may be provided with one or more apertures primarily intended for alignment with alignment features upon the backing disk, so that the sanding disk can on installation be aligned so that apertures within the sanding disk are matched with apertures within the backing disk.

Optionally the one or more alignment apertures may also serve as engagement means to mate with drive pins extending from the backing disk.

Optionally, one or more apertures are provided in the sanding disk in positions capable of matching air extraction apertures within a backing disk.

In a preferred aspect the perimeter of the sanding disk may be distorted from a circular shape by the provision of one or more gaps, most preferably in the form of segments, around from the circumference of the disk. Where a plurality of such gaps are provided it is preferred that they be symmetrically located to maintain balance in the disk. Preferably there are from three to eight gaps.

More preferably the number of gaps matches the number of non-concentric apertures adapted for viewing and ventilation, and are located on radii between those on which the apertures are located.

Preferably each gap has the shape of a straight line joining one part of the circumference to another. Otherwise expressed, the gap is formed by removal of a segment of the disk.

Preferably the dimensions of the or each gap are adjusted so that when the sanding disk is rotated, it is possible to see through the disk in the zone outside that of the viewing/ventilation apertures, and as far as the edge.

Optionally this type of gap may be used advantageously in the procedure of cutting sanding disks from stock material, by bringing disk centres closer to each other and having common edges between adjacent disks, so as to minimise waste.

Optionally some or all gaps may have a curved outline.

A preferred curved outline is one that is drawn in towards the trailing edge of a viewing/ventilation aperture, thereby providing a narrowed or weakened zone capable of being torn should a projection engage with the viewing/ventilation aperture.

The surface of the abrasive disk can have a number of configurations. In a first embodiment the surface is provided by a coating of abrasive particles adhered to the surface of the disk by a binder material selected from cured resinous binders or metallic bonds. In a further embodiment the surface of the disk comprises a non-woven layer of fibers having bonded to the fibers a plurality of abrasive particles. Such non-woven layers are conventionally bonded to a backing material imparting a higher degree of dimensional stability to the whole disk structure.

In still another aspect the sanding disk may be provided with one or more peripheral folds—or "wing tips"—that are directed away from the abrasive surface, so that when the disk is rotated air is caused to move thereby further cooling the work area and directing the abraded material away.

In a related aspect a skirt may be provided around the guard of the angle grinder so as to confine the air brought into motion by the wing tips.

In yet another aspect the sanding disk is also provided with one or more shearing sites, "tear zones" or deliberately provided points of weakness capable of disconnecting the disk from the drive means of the backing plate if the disk inadvertently engages with an object and attempts to transmit a high torque to the backing plate and to the angle grinder. A preferred shearing site comprises a weakened zone concentric with the mounting means or aperture.

Preferably this weakened zone is formed from a series of apertures cut into or through the material of the sanding disk.

Optionally this weakened zone is formed from a series of slits cut into or through the material of the sanding disk.

Preferably a disk retaining nut tightened onto the arbor of the angle grinder is capable of retaining the torn-off sanding disk; preferably by means of a concentric, outwards-directed projection or the like provided towards the periphery of the disk retaining nut; the projection having a diameter large enough to include the weakened zone.

In any case the sanding disk should preferably remain substantially dynamically balanced about its axis of revolution.

Preferably the disk are used with a backing plate made of a resilient material, and preferably the material of the backing plate has a dark colour.

Preferably the backing plate includes at least one gap or aperture, positioned so as to be capable of alignment with the one or more non-concentric apertures adapted for viewing and ventilation provided within the sanding disk.

Preferably the or each gap or aperture in the backing disk is similarly provided with slanted or raked surfaces, and optionally each aperture may be provided with an air scoop.

Optionally the backing plate may be provided with further apertures substantially not capable of alignment with the non-concentric apertures adapted for viewing and ventilation in the sanding disk and one or more of the further apertures may be used for alignment purposes.

One or more of the further apertures may be used for purpose of driving the sanding disk, by means of engagement means held within said further apertures.

One or more of the further apertures may be used for air and material removal purposes; being connected to air extraction channels within the backing plate.

Preferably such extraction channels run outward from the removal aperture towards the periphery of the backing plate, so that in use air is moved through the channel by a centripetal force.

Yet further apertures in the backing plate may be provided in order to give the backing plate a weakened zone that may be ruptured if a protruding object is caught in a viewing/ventilation aperture.

Preferably the resilience of the combination of sanding disk and backing plate is sufficient to provide a significant flexibility of the actively abrading disk during use, so that more than just the edge of the disk can be in effective contact with a work surface.

In an alternative embodiment the backing plate itself is provided with clutch means capable of becoming disengaged from the drive shaft if the torque applied through the clutch means exceeds a pre-set limit—as for example if the backing plate inadvertently grips an object.

Another preferred embodiment of a clutch means is an overload clutch built into the material of the backing plate. This may comprise a shear pin.

Yet another preferred embodiment of a clutch means comprises a modification by lengthening of the shaft of a retaining nut and a modification by provision of a shaft for a thrust washer so that tightening the retaining nut against the thrust washer (when mounting a sanding disk and a backing disk forms an overload clutch acting in a manner analogous to a shear pin, allowing slippage, in the event of excess torque, between the backing plate and the retaining nut/backing washer assembly.

Preferably at least one hole in the backing plate and at least one hole in the sanding disk may be used in conjunction with a locating peg or pin to rotationally align the sanding disk on the backing plate so that the apertures are substantially in alignment. Preferably the locating peg or pin is removed after attachment of the sanding disk and before use.

Optionally a locating pin or projection included in a sanding disk and for alignment purposes inserted into the backing plate may also act during use as a shear pin.

Optionally an overload clutch may include serrations or the like capable of creating a vibration or noise against a projection when the clutch is slipping.

Preferably the invention also provides a guard for an angle grinder, adapted to protect the user from injury resulting from the spinning sanding disk and/or the backing plate; the guard comprising a protective cover mounted at least one of the threaded sockets for the gripping handle and projecting forwards between the sanding disk and the operator.

Preferably the guard is made of a tough clear plastics material; alternatively at least a part of it may be made of metal. Also preferably the guard is fixed in place. Alternatively however the guard may be adjustable and moved forwards or backwards from time to time, thereby acting as a gauge plate.

In a further broad aspect the invention provides a process and apparatus for the manufacture of preferred shapes of abrasive disk by using a liquid lance or liquid cutting process, in which a liquid emerging from a small nozzle under high pressure; the nozzle being capable of movement relative to one or more layers of an abrasive sheet, cuts through the abrasive sheet to separate sanding disks and/or flaps.

Alternatively the cutting process may be a burning process using intense light, as from a laser. Preferably the movements and cutting actions of the cutting process are controlled numerically from a stored sequence of instructions. Preferably the cutting process uses an array of nozzles working simultaneously in order to make a number of shapes at one time.

DRAWINGS

The following is a description of a preferred form of the invention, given by way of example only, with reference to the accompanying drawings in which:

FIG. 1: shows outlines (plan view) of a preferred three-hole abrasive disk or sanding disk, according to the invention.

FIG. 2: shows outlines of a preferred five-hole abrasive disk or sanding disk, according to the invention.

FIG. 3: shows outlines of three preferred backing plates, each having three viewing or ventilation gaps, according to the invention.

FIG. 4: shows two outlines of preferred backing plates, according to the invention.

FIG. 5: shows the profile of a preferred aperture or gap in a sanding disk or a backing plate, adapted to prevent against catching protrusions from the work surface, according to the invention.

FIG. 6: shows the side view (elevation) of a preferred backing plate, according to the invention. One type of a locating pin and an aperture for it in the backing plate are shown. This figure also includes a section through a backing plate having a raked hole and an air scoop away from the abrasive surface, and a lifted trailing edge on the abrasive surface.

FIG. 7: shows the front and rear surfaces of another preferred backing plate, provided with cooling channels according to the invention.

FIG. 8: shows the side (elevation) view of a preferred abrasive disk or sanding disk mounted upon a backing plate and provided with studs for engaging with an abrasive disk.

FIG. 9: shows the user's view (elevation view) of a preferred abrasive disk or sanding disk (of FIG. 1) mounted upon a backing plate (of FIG. 4) according to the invention.

FIG. 10: shows a preferred abrasive disk or sanding disk provided with raised areas trailing the three large apertures, and a shearable or weak section (three types of weakened portion are included in the one drawing), and three versions of a holding nut for fixing it to an arbor of an angle grinder.

FIG. 11: shows in section three versions of a backing plate provided with clutches for slipping in the event of too much torque being applied.

FIG. 12: shows the working face of an abrasive disk or sanding disk provided with multiple flaps of abrasive material according to the invention. (Two flap orientations are shown in the one drawing).

FIG. 13: shows the working face of another abrasive disk or sanding disk provided with multiple flaps of abrasive material according to the invention.

FIG. 14: shows the working face of an abrasive disk or sanding disk provided with multiple (10) holes, wherein the positioning of holes allows viewing through a substantial portion of a spinning disk.

FIG. 15: shows the working face of an abrasive disk or sanding disk of a type using a sandpaper manufactured with a contact adhesive surface according to the invention. (See FIG. 23 also).

FIG. 16: shows the rear (non-sanding) face of several versions of an abrasive disk or sanding disk of a type with one or more segments removed, having increased edge visibility during use. The insets show how such disks can be cut from a sheet of material with relatively little waste.

FIG. 17: shows the rear (non-sanding) face of a backing disk of a type with one or more segments removed, having increased edge visibility during use. Extra raked cooling holes are also provided.

FIG. 18: shows a hole in a sanding disk or backing plate, with its non-catching capability enhanced by forming (as by pressing) a trailing edge deformation in the material, according to the invention.

FIG. 19: shows in section a further preferred clutch assembly for a sanding disk for an angle grinder.

FIG. 20: shows some designs for a guard for an angle grinder to be used with sanding disks according to the invention.

FIG. 21: shows a way to cut multiple or single stock abrasive sheet with a high pressure jet of liquid to make sanding disks according to the invention.

FIG. 22: shows some ways to pack cut-outs together in order to save on stock abrasive sheet.

FIG. 23: shows ways to lay and shape adhesive-backed sanding disks onto a foam backing plate, the disk and the plate being modified according to the invention.

FIG. 24: shows a sanding disk with (a) non-catching apertures and (b) alignment holes within a tear-out zone.

FIG. 25: shows a sanding disk in correct alignment on a backing plate—operator's view.

FIG. 26: shows a backing plate having a grip pad—like a ring of sandpaper—intended to grip a sandpaper disk (such as FIG. 24) inside its tear-out hole zone.

FIG. 27: shows a backing plate suitable for use with a contact sanding disk.

FIG. 28: shows one version of a contact sanding disk with (a) vision/cooling apertures, (b) indexing/alignment holes, Ⓒ fold lines, and (d) vacuum apertures.

FIG. 29: shows another version of a contact sanding disk with (a) vision/cooling apertures, (b) indexing/alignment holes, Ⓒ fold lines, and (d) vacuum apertures.

FIG. 30: shows a four-sided sandpaper disk with (a) wing tips, (b) air-scoop holes, and (c) a tear-out hole zone.

FIG. 31: shows the four-sided sandpaper disk in position upon a backing plate.

FIG. 32: shows a backing plate compatible with the sanding disk of FIG. 30, having (a) a grip pad, (b) cooling channels, (c) a structurally weakened breakout zone, and (d) index alignment means.

FIG. 33: shows a backing plate in section and a matching four-sided sanding disk, having apertures, break-out zones, and a concentric weakened or tear-out zone. The backing plate has a grip pad—like a ring of sandpaper—intended to grip a sandpaper disk inside its tear-out hole zone.

FIG. 34: shows a three-sided sandpaper disk in position upon a suitable backing plate.

FIG. 35: shows a backing plate compatible with the sanding disk of FIG. 36, having (a) a grip pad, (b) cooling channels, and (c) index alignment means.

FIG. 36: shows a three-sided sandpaper disk with (a) wing tips, (b) apertures, and (c) a tear-out hole zone.

FIG. 37: shows a backing plate in section and a matching three-sided sanding disk, having apertures, break-out zones, and a concentric weakened or tear-out zone. The backing plate has a grip pad—like a ring of sandpaper—intended to grip the sandpaper disk inside its tear-out hole zone.

FIGS. 38–41 are graphs and a bar chart showing comparative performance of disks according to the invention and prior art disks.

PREFERRED EMBODIMENTS

The accessories to be described herein for use with an angle grinder include a disposable rotary sanding disk (where "disk" is as defined above) having one or more relatively large viewing/ventilation apertures, and a resilient backing plate, also having similar viewing/ventilation apertures which has been developed particularly for use in conjunction with the disk. The large apertures allow the operator to see the work surface while it is being abraded. It appears that the large apertures are also of great benefit by allowing the work surface to stay significantly cooler than when a prior-art unperforated disk is used.

Fears as illustrated by what is available in the prior art—that the holes might entrap projections from the work surface—are unfounded in trials; the high rotation speed together with raised trailing edges on the holes appears adequate to prevent a projection from entering the apertures of a spinning disk. The holes also assist in providing the disk with more resilience than has usually been expected of a sanding disk. Means (see FIG. 6 and FIG. 9 and particularly FIG. 23) for mounting the disk on the backing plate in alignment may also be provided.

Observations made by the use and developments of this invention have established that a definite increase in efficiency and performance in sanding disk operation is achieved by the creation of air turbulence between the spinning abrasive surface and the work surface or material being abraded. This appears to generate a significant cooling effect. There is also a benefit from intermittent cutting—allowing a small measure of time to elapse between cutting intervals. There is a "rest time" occurring several times during each revolution of one of our improved sanding disks. It has been determined that the best results are achieved by using a small number of large perforations set back at an appropriate distance from the perimeter of the sanding disk and spaced at positions around the sanding disk, so that the balance of the disk is not upset. We also provide optional gaps in the originally substantially circular periphery. Perforations are preferably raked to increase air flow in conjunction with the backing plate, with increased cooling benefits also gained by incorporating extra ventilation between the backing plate surface and the sanding disk. A by-product of this cooling method has proven to be excellent see-through capabilities whilst in operation.

A quantitative scientific investigation of these effects would require sophisticated equipment, such as a thermal camera looking through disk apertures to view and measure the temperature of the surface being sanded (at a calibrated rate) by various disks under trial, or airflow measuring devices, and presumably there are standard test methods to determine the lifetime of sanding disks when used in various ways.

The prior art in this field, being concerned about disk collapse and catching protrusions, has relied on using many small perforations in the disk in relation to total disk size. Our invention has also provided safety tear out centers and release mechanisms built into the backing plate as well as the benefits of much increased cooling air flow. Resilience also reduces the suddenness of onset of abrasion against a solid surface. The indexing alignment features of this invention are useful as is the option to increase unit production from the same given amount of "raw" product.

In contrast to the prior art our invention uses a small number of large ventilation/viewing perforations in proportion to the sanding disk size, and with the exception of flapper disks, relies on a special relationship between a modified backing plate and modified fibre and fabric-based sanding disks. This invention also makes possible a more flexible and controllable sanding operation not normally associated with angle grinder usage.

The sanding disk is preferably of the usual industry-standard diameter; usually between 4 and 7 inches (or a metric equivalent) and can be made of the usual reinforced fibre base to which an abrasive surface has been made adherent. The material from which the disk is made can however also be plastic, such as a film, paper or even metal. Metal disks are in fact preferred where an abrasive, especially a superabrasive such as diamond or CBN, is metal-bonded to the surface of the disk to provide the abrasive surface.

The disk is typically used in conjunction with a backing plate where it has insufficient strength to be used alone. This is indeed most often the case since the disk is intended to be readily replaceable and usable supported on a standard backing plate. It is however possible that the disk is integral with its own backing plate which has the same overall shape as the disk and which confers the necessary rigidity and dimensional stability. Such a disk can then be attached directly to the arbor of a rotary grinder. This option is particularly preferred when the disk is already required to be dimensionally stable to perform in the intended manner. Such disks are referred to herein as "rigid disks" to distinguish them from the disks primarily intended to be used in conjunction with a backing pad. Rigid disks include for example flap disks, (as hereinafter described), disks in which the abrasive surface is provided by a non-woven fabric having abrasive particles adhered to the fibers thereof (as hereinafter described), and metal disks bearing particles of a superabrasive metal-bonded to a surface thereof. In such cases it is preferred that the rigid disk has a recessed portion surrounding the mounting aperture so that the disk can be used flat without the mechanism for attaching the rigid disk to the arbor of the grinder coming into contact with the work surface. In such rigid disks the integral backing plate has the same apertures and the same basic shape as the disk.

The disk has a central mounting or attachment aperture, and in addition has a number of apertures which have the combined purposes of (a) providing a flow of air over the work surface, (b) allowing the operator to see the work while actually abrading it and (c) making the disk backing material less rigid, and alleviating possible stresses within the disk material. (Optionally a contact adhesive may be used to fix the disk to a backing plate (see FIG. 15) or "Velcro" (™) or the like may be used). Prior-art apertured sanding disks are known (e.g. Bosch and see above) but those on sale are used solely as part of a dust-extraction system and the extraction system prevents viewing. The typical appearance of prototype sanding disks is shown in FIGS. 1 and 2—where three holes in FIG. 1 are shown as 101 (the central mounting hole is 102) and FIG. 2 illustrates that the invention 200 can have any reasonable number of holes such as the five ventilation/viewing apertures here illustrated as 201, or the ten hole version of FIG. 14. A one-hole disk (with a balancing segment removed from an edge) is shown in FIG. 22. The invention is of course not limited to the embodiments illustrated. The example of FIG. 2 also includes an array of holes 203 used as a deliberately weakened region (see later) and also non-circular apertures 202, which are substantially radially oriented slots.

Later in this Application we shall describe our optional vacuum apertures. They are placed close to the centre of our sanding disks and are aligned with apertures in the backing plate, similar to the Bosch prior-art, except these apertures draw their vacuum not from the fan built into the motor of the power tool or some other external source but from ducts sandwiched inside the backing plate or open channels, between the backing plate and the sanding disk paper. The centripetal force developed on air occupying the ducts will, when the disk is spun, create the required vacuum in the ducts. Dust can then be blown into a collection trap that then funnels dust into a collection bag. To help the process, the periphery of a backing plate can have veins or scallops moulded into its edge (circumference).

In one preferred form, the sanding disks are adapted to be used with a conventional angle grinder of the widely used type having a typical no-load rotation speed of 11,000 rpm, driven usually by a universal (AC/DC) brush motor. Conventional angle grinders provide a drive shaft on to which various disks (normally of abrasive material) may be mounted and spun at a high speed. A typical angle grinder is the single-speed 115 mm grinder sold as the "AEG WSL115" (™) (600 watts). This size of motor provides an acceptable power for the prototype disks, which generally draw less power than "solid" prior-art disks though having an equivalent performance. Here, it is thought that air-bearing effects, rest-time effects, and cooling may be responsible.

VIEWING

Apertures or perforations (101, 201) in the disk are provided in part so that the user can see the material to be abraded through the spinning disk as he/she is using the grinder, generally by drawing the tool towards himself/herself. For convenience the apertures are circular or at least have no sharp or narrow corners because of the higher risk of propagation of cracks from stressed areas as opposed to circular holes. Nevertheless we show a diamond-shaped, raked hole in FIG. 2 as one optional shape. Holes having a narrow end and a wide end (perhaps the narrow end is placed at the leading edge) can be used as one of many options. Many other options exist; such as narrow slots running at an angle to radius lines or perhaps along curves that follow stress lines of the disk when in use. Three 22 mm diameter holes 101, equidistant from the centre have been used in early prototypes but many other combinations are possible. Clearly, hole positions should preferably be selected so as to retain the balance of the cutter, and cutters may be balanced dynamically by removing material from hole edges.

In relation to the viewing aspect, it is very useful to be able to see and monitor the abrading action while it is in progress. Most sanding disks do not allow viewing to occur during sanding. The anatomy of an angle grinder does allow viewing through the outer half of a spinning disk, and these sanding disks have been developed to take advantage of that construction. If sanding is carried out with an opaque disk (the usual situation) the operator has to make a series of test abrasions, each time removing the tool to view the result, and as the job nears completion these inspection pauses have to be more and more frequent. The job completion process is a kind of successive approximation, and there is a possibility that the abrading process will be taken too far. Using the present invention the operator can carry out an abrasion operation in one application of the tool to the work and there is little need for judgement as to the speed of wearing down, and the risk of going too far. It is perhaps surprising that the presence of substantial apertures in the disk and the backing plate does not (as one might expect) allow protruding objects to entangle with the hole and cause catastrophic disruption to the sanding process. In fact one can bring the spinning disk down hard onto a protruding nail and watch the nail being worn down with little or no problem, though for safety reasons one might prefer to arrange that the disk meets the nail at an angle less that 90 degrees in order to reduce the risk of the nail digging into the disk or the backing plate.

We have realised that designs having circular outer profiles have not addressed the problem of concealment of portions of the work at the extreme edge of the rotating disk. Disks from FIGS. 1 to 15 have circular profiles. Therefore we have invented a disk 1600 having several segments 1603 removed, as shown in FIG. 16. These segments may be straight (1603), or curved (1604) or even gap-like (1605). There may be from one segment upwards; while we prefer three or four in the prototype disks, five (see 1605) or six are feasible and it would be possible (FIG. 22) to make a disk having an eccentric edge (one indentation or gap) balanced by one or more apertures elsewhere. As a result, the work beneath the disk can be viewed right up to the edge of the disk, if the removed segment in one place overlaps with a hole in another part of the disk, and so the entire working portion of the disk "greys out" during use. (This lack of obviousness may lead to a hazard—see the section on guards later).

Disks in which the edges were scalloped or given a toothed appearance have been used in the past. This was done primarily to make the edges more flexible but also to prevent or limit abrasion in tight corners. The edge treatments did not confer visibility of any part of the grinding area because the disks were used with solid backing plates. The lack of grinding performance at the edges was an intentional characteristic of such disks and this clearly distinguishes them from the present invention. The disks were also not provided with apertures in the body of the disk to permit viewing and/or cooling.

On advantage of removing chord segments from the disks is that, at the time of stamping disks out from the original stock material, the centre of each disk may be brought slightly closer to adjoining disk centres, so that more disks can be cut one by one or in stacks (if the stock is multi-layered) from a given area of stock material, as shown at 1606 which is one example of closer packing of disks having segments cut off. This reduces manufacturing costs. Indeed, the inner profile of one segment may comprise the circumference of a neighbouring disk. This inner profile may be a deeper indentation (called a "throat": more than 5 throats may be a satisfactory number), or may be curved, with a sharper leading angle and a shallower trailing angle. Possibly the stamped-out portions can be recycled and used on flap disks. FIG. 21 shows an example flap at 2114 and how 15 flaps (2115) can be cut at the same time as one disk is made, leaving very little waste material.

While it might be thought that removal of segments would result in a higher risk of marking the work because of an irregular rim, the resilience of the rim that we seek in our versions together with high cutting speeds seems to minimise that risk.

AIR COOLING

There is a detectable current if not a blast of air emerging semi-tangentially around a spinning disk made according to the invention and rotated at the typical 8000–11000 revolutions per minute typical of a 4.5 inch/115 mm angle grinder. It appears that the raked holes from the rear (the operator side) cause significant air turbulence at the abrasive surface and swarf tends to be expelled out to the sides or through the apertures. During use against a surface in some circumstances, air may be carried to the surface presumably as shown in FIG. 6 and here it helps to cool the work, blow dust away from the site of abrasion, and remove broken-off abrasive particles (which being hard are likely items to cause abrasion of the tool itself) from the working area. This is most likely to occur using the air scoop illustrated in FIG. 6 and this is worth explaining. The arrow 615 shows the direction of movement of the backing plate in relation to the air and the work surface. The portion of the backing plate leading the aperture 612 is cut away, and the trailing edge 613 may be brought upward as a kind of scoop, so that some air is rammed into the aperture 612. There may well be significant compression as the air reaches the surface being abraded (at around 616) where we usually raise a portion of the backing plate and sanding disk trailing the aperture. (This raised portion also helps to minimise the risk of catching a protrusion). The air may also act as a kind of bearing, forcing itself between the spinning disk and the stationary work in a manner analogous to an air bearing. At the rear of the sanding disk, which tends to flex against the backing disk when it is pressed against the work there is also some to-and-fro air movement which will help to forcibly cool the back of the sanding disk. We also provide slanted channels as an option—see the discussion of the embodiment described in FIG. 17. Normally however the contours of the back of the backing plate often generate a negative pressure within the aperture through the backing plate and this may give rise to an air flow within the aperture in the opposite direction, that is, away from the work surface. In either case there is turbulence generated at the work surface and this helps significantly in swarf removal. Careful contouring of the aperture openings in the backing plate can enhance this effect.

While a rake (or slant) of the leading and trailing edges of the holes that are made through the sanding disk itself might, in addition to providing snagging protection, somewhat enhance air flow, it is generally difficult to produce a substantial air turbulence effect in such a thin material and this function is preferably provided largely by building a rake effect into the backing plate, which may be 3–5 mm thick in the region of the holes. This is shown in FIG. 6; a shaped sheet is shown in FIG. 5 or FIG. 18. (Of course a thicker sanding disk will be capable of supporting fully functional raked holes and could show the claimed effect even in the absence of a backing disk. Commercially, most abrasive material is sold as thin sheets for use with a backing plate.). Consequently the leading border of each hole is slanted away from the perpendicular. FIG. 5 shows the preferred arrangement and in that drawing 500 is a cross section through a portion of a sanding disk or through a backing plate, including a gap or aperture. The preferred direction of rotation is indicated by the arrow 507 and the abrasive surface is downwards. The leading edge 505 of an aperture or gap 502 is slanted to leave an acute angle at the edge closest to the abrasive surface, while the trailing edge 504 is slanted so that an obtuse angle is closest. (506 shows a further raking shape which may be used to minimise the risk of the disk catching a projection). Even without an actual raking of the sanding disk apertures themselves, there is significant and useful air turbulence caused by the motion of the apertures in the backing plate when the disk spins at a high speed. We cannot measure the actual air movement with the equipment we have at present. All that we can determine is that the work surface stays significantly cooler.

We have developed a preferred way to provide a raked hole effect in an ordinary sanding disk of a typical thin material. This comprises a pressing operation that deforms the material of the disk so that the portion of the disk immediately trailing the hole (when rotating in its preferred direction of rotation) is pushed away from the abrasive surface. FIG. 18: shows a raked hole 1801 within a sanding disk 1800, its capability enhanced by forming of the material of the sanding disk or backing plate, according to the invention. The leading edge 1803 is generally not deformed but the trailing edge 1802 is bent away from the work surface. The region 1804, though abrasive, is unlikely to catch on a projection even if the disk is turning slowly because it is at a gentle slant. By incorporating such a deformation, the principles of the invention can be applied to a disk alone, without requiring a backing plate having raked holes. The forming process can be a simple pressing operation carried out between suitable dies at the time of stamping of the sanding disk from bulk sheet abrasive material.

Even though we have observed that there is little likeliness of catching a projecting object at the trailing edge of a hole, or the like, (partly because there is a new hole presented during use (10,000 rpm) at about every 2 mS) the deformation shown in FIG. 18 helps to minimise the risk (such as when the tool is slowing down) by providing a gentle slope for the object to glance off, rather than an abrupt corner to engage with it.

The air movement has a cooling effect. We have observed the temperature reached by an iron object (a nail) while it is being abraded by the sanding disk. (Nails are a useful test object because they are often encountered during sanding operations on used wood). When using a conventional (entire) sanding disk the head of the nail may become red-hot and will certainly burn a finger. A conventional sanding disk will be destroyed by the heat. When using a perforated sanding disk according to the invention, the nail, though being worn down at a comparable rate, remains cool enough to be touched. The adjoining timber is not overheated and burnt or at least discoloured. One test reported an about 120 deg F. reduction in temperature over that produced by use of a plain sanding disk, but the exact operating parameters are not known.

Two backing plate or disk outlines are shown 300 and 400 respectively in FIGS. 3 and 4; FIG. 4 is "improved" in that the periphery of the disk is extended outwards from the position (shown by dotted lines 301) of FIG. 3. These backing disks include gaps 303. The arrow 403 shows the direction of rotation. It is possible to produce a resilient backing disk that extends to substantially the full diameter of a sanding disk and in this case it may be preferable to provide apertures rather than gaps. Preferably the number and placing of holes in the sanding disk match those of the backing disk. In use, the operator placing a sanding disk on a grinder might visually align the ventilation/viewing holes 101 in the sanding disk with the gaps or holes 303 in the backing disk. Or he/she might use a locating peg or pin (that shown at 603 in FIG. 6 is one embodiment; FIG. 23 is another) in order to hold the disk in place during rotation of the tightening nut. This is a relatively precise way to align the disk. Preferably the locator peg is removed before use. FIG. 9 shows at 900 a sanding disk 100 beneath a backing disk 401, with the holes of the sanding disk in good alignment with the gaps of the backing disk. FIG. 9 also illustrates a sanding disk having locator holes 905 which substantially match holes 601 in the corresponding backing disk.

Interestingly, the backing disks of this invention assist ordinary sanding disks—those that are solid disks—thanks to their resilience.

FIGS. 6, 7, and 8 show some preferred backing plates from the side—elevation view. That of FIG. 6 (600) is preferably made of a resilient compound such as a rubber or a plastics material and is relatively stiff because its profile remains thick relatively close to the edge. Note the locator hole 601 for use with a locator peg 603. The backing plate of FIG. 8 (at 800) is more resilient (assuming similar materials) because the outer portion is relatively thin close to the edge. FIG. 8 also shows a curved or dished shape which we have found preferable—it allows use of the resilience of the sanding disk itself (803 in FIG. 8) alone when lightly sanding an object. A flat sanding disk may, after some use itself may take on a slightly dished appearance because of the way that force is applied about the edge of the disk. Perforated disks are more resilient than unperforated disks.

FIG. 6 also includes one means (of many possible methods) to conveniently set the orientation of the sanding disk in relation to the backing plate, when mounting a new disk on an angle grinder. There is a set of holes 601 provided in the backing disk. Corresponding orientation holes 905 are provided in sanding disks, and as can be seen, these are preferably in a fixed relationship to the repeating structures of the sanding disk, so that for example three possible satisfactory orientations of the sanding disk results in three holes 905. While mounting a sanding disk and before the retaining nut is tightened, the operator pushes a locating peg or pin (shaft 603 and head 604) through the disk and into the corresponding hole in the backing plate so that the disk is held in substantially the correct orientation while tightening the retaining nut. The locating pin, which may be made of a plastics material, is then removed. In practice a typical operator may use a nail or the like as a substitute for a locating pin, and clearly it is useful to remove the nail before commencing use. (Locating pins may be cheap enough to pack with every sanding disk). It may be preferable to make sanding disks with locator peg structures permanently attached to the rear of the disk, although at the present time disks are simply stamped out from stock sandpaper sheets. In that case the locator peg structures may serve a dual purpose of shearing and giving way if too much torque exists between the sheet at the disk—if, for example, a protruding object is inadvertently gripped.

We believe that many synthetic materials which are otherwise prone to melt and then fill the spaces between the abrasive particles on a sanding disk remain cooler and are less likely to clog and spoil the disks of the invention. The disk itself presumably enjoys a longer life if it does not overheat.

Accordingly, we have added further holes in a backing plate. These may be raked. Raked holes move air directionally, but even unraked holes improve cooling. When the disk and backing plate are rotated, access is provided for air to reach the rear of the sanding disk, and cool it. Raked holes increase the total flow of air and render it more unidirectional, so are preferred though not essential. FIG. 17 shows the rear (non-sanding) face of a backing disk 1700 of a type with one or more segments 1701 removed, having increased edge visibility during use. Extra raked cooling holes 1702 are also provided. The segments 1701 which, like the larger viewing apertures, are intended to line up with corresponding voids in the sanding disk in order to provide visibility of the work during the actual sanding operation.

DISK PROPERTIES

The holes together with the preferred type of backing plate give the sanding disk more resilience than an ordinary disk used with an ordinary hard backing plate. The normal pattern of use is to apply the spinning disk to the work at a region near one edge and with the preferred degree of resilience this may mean that the outer ⅓ to ½ of the disk momentarily contacts the work during each revolution. Benefits of this include that the disk wears more evenly over its abrasive surface. Examination of well-used disks show that the outer half (measured along a radius) of the disk is relatively evenly worn, while portions near the central mounting hole remain largely unworn. The outer perimeter of the sanding disk is still present. (In contrast, an ordinary disk used with an ordinary hard backing plate tends to wear in a narrow perimetric rim and the material of the rim of the sanding disk is lost). We expect the average lifetime of a sanding disk to be increased by up to about 20%, even though there is less abrasive material included per disk.

We believe that the holes may take out some of the stresses that build up in a sanding disk. It is common for a new sanding disk to be curled up when it is first taken from a packet. Attempts to straighten the disk can lead to cracking of its adherent abrasive layer. Use of it in a curled state results in hard-to-control thumping. We have noticed that disks including holes are less likely to exhibit and hold the curling phenomenon and show the consequential thumping effect when used.

Furthermore, the presence of holes makes the perimeter of a sanding disk according to the invention more flexible. This is quite useful for more gently abrading a surface. We have also taken advantage of this flexibility by using a backing plate that has a smaller diameter than that of the sanding disk. A typical relationship is shown in FIG. 9 where it can be seen that the backing plate reaches out to about the furthest extent of the viewing/ventilating apertures. Although prototype backing plates have a circular circumference, it may be preferable to shape the perimeter as in FIG. 4 in order to optimise the kind of support provided to the sanding disk. Furthermore one preferred shape of backing plate itself has a slight cupping (see FIG. 8); that is, its outermost portions are slightly raised (taking a work surface as a reference plane) as compared to the more central portions. This means that the backing plate provides very little support until at least some pressure has been exerted upon the disk. On the other hand, some flat backing plates can provide a similar effect.

The disk/plate movement can assist air to reach the rear of the disk and cool it. We have also designed a backing disk having channels to circulate the air in the space between the backing plate and sanding disk. FIG. 7 shows the principles. The disk 700 shows the rear (operator side) of a disk, with air holes shown at 703 and 705. Buried channels spiral out through the substance of the disk to reach the sanding side (see 701) where they may lead into the viewing/cooling apertures 702 or be made into channels 706 that lead out to the circumference. Centrifugal air movement occurs when the assembly rotates. This type of configuration is useful with thick backing disks—such as the foam ones favoured by auto refinishers.

Note that we have chosen to use a disk having a small number of large holes primarily for viewing and ventilating purposes. (The word "hole" here means an aperture of any shape). It is possible to produce disks having many holes, perhaps even a hundred or so, if cooling and/or flexibility is the primary desired result. Nevertheless we mainly prefer to develop the viewing/ventilating attributes, although there may be sanding applications that we have not considered wherein resilience is of much greater importance.

Clearly the type of material used as a substrate for the sanding disk is of greater importance than may have hitherto been thought, particularly because the invention enhances the sanding process using an angle grinder and a sanding disk, and makes it a more versatile and precise operation than has generally been believed. We have concentrated on the anisotropic fibre backed disks rather than the type in which a textile having clearly oriented fibres is used. Centrifugal force tends to render a spinning disk less resilient—at least in the position where it engages with the work—than a stationary disk, but the principles explained herein still apply at normal angle grinder rates of rotation.

Backing plates are preferably coloured black, in order to enhance visual contrast for a person looking through a spinning disk and relying on persistence of vision to see the work behind. This colour is less obtrusive than white, which tends to result in a greying out of a view of a work surface seen through a white or other light-coloured disk.

BUILT-IN SHEARING

It is useful for the invention to include safety features so that if the sanding disk somehow tightly grips a workpiece during a sanding operation it can be torn off the backing disk—or somehow disengages itself from the driving system so that no further adverse consequences follow. FIG. 10 shows some variations by means of which the sanding disk itself 1000 can be made frangible. It is provided with shearing/tearing points 1003 (sharp-cornered apertures) or alternatively circular apertures at 1004, or alternatively a series of tabs 1006 directed towards the centre so that the weakened zone gives way if an excessive torque is applied. Other ways to impose a weakened zone can be used such as 1010, 1003 and 1004, and a series of slits (which may or may not completely penetrate the material of the sanding disk) forming an interrupted circular line 1008 is a further way to do that. A retaining nut 1001 for holding the sanding disk and the backing disk onto an arbor of an angle grinder is also drawn; its sectional view is at 1005. Preferably the disk 1000 remains captive beneath the periphery of the head of the nut after shearing, preferably provided with a raised portion 1002 to allow slippage, so that the disk does not fly free of the tool and possibly cause injury. Most nuts have a chamfer 1007, as shown in the example 1006, to aid in gripping the disk. The nut of 1011–1012 is designed to hold only the backing plate to the arbor, and assumes that the sanding disk is held onto the backing plate by other means, such as the projections 805 shown in FIG. 8. The disk in FIG. 10 shows raised portions trailing the holes, as at 1013.

It is also possible to equip the backing plate itself with a clutch or releasing type (shear pin) mechanism of some type so that excessive torque cannot be transmitted past the clutch. Where plates having some form of gripping means over their entire surface are used, a clutch within the backing plate is preferable. This has the advantage that sanding disks are not so often wasted, and it also provides for the situation wherein some object engages with the backing plate itself, perhaps through the ventilation/viewing holes. (This is possible if a variable-speed angle grinder is driven only slowly, or if any angle grinder is put down before it has come to a fill stop and the still-spinning disk engages with some generally protruding object). FIG. 11 shows three examples in section; all of which can be made in a resilient material as a casting or forming operation. Feature 1102 illustrates a V-shaped tongue-and-groove formation while 1104 shows a more tongue-like variant and 1103 shows a slip ring (which may be embedded in either the inner or outer portion of the plate, or even both. The version shown at 1102 may be liable to give way if too great a side force is applied. Any of these clutches may be provided with a regular distortion of the sliding surfaces (such as a ratchet type of shape, or a shear pin 1106) so that slipping of the clutch is clearly evident during use as a kind of vibration, noise, chatter, or free spinning and the operator will know to reduce the pressure applied. Holes to engage with a tightening spanner may be provided as at 1107.

An improved clutch or release mechanism for a backing plate for an angle grinder can be made from a modified retaining nut and thrust washer, as shown in FIG. 19 which shows this assembly 1900 in section. The thrust washer 1904 differs from the type normally sold with backing plates by (a) having the spigots (that engage with depressions in the backing plate) deleted, and by having an extended shaft. This and the extended shaft of the retaining nut 1901 are made to be of such a length that, when screwed together by tightening the retaining nut about the backing plate 1907, the backing plate is gripped only tightly enough to hold it during normal working torque. When excess torque is applied, the backing plate can slow or stop while the nut/washer assembly 1901+1904 continues to be driven. Preferably there is some means to make a noise or cause vibration so that the operator is aware that slippage is occurring before friction-developed heat affects the equipment. This may comprise a toothed hub 1909 in the backing plate, which engages with a pawl 1905, or a spring and ball, or shear pin, or the like projection(s) from one or other of the thrust washer 1904 or the retaining nut 1901. (Alternatively the teeth may be included in the nut/washer assembly and the projection in the backing plate). Possibly the combination of teeth and pawl may themselves partially or completely define the torque at which the clutch gives way.

FIG. 12 illustrates a version 1200 of the sanding disk of this invention, bearing multiple flaps of abrasive material. These devices generally come with their own backing plate 1202. Flaps may be attached in radial lines as at 1201, or at a slant (as beside the marker 1202). A series of small holes 1203 provide a weakened zone in case the disk grips an object, but a preferred weak point is a slip ring 1303 and a shear pin 1304. The tangential flaps may tend to cause the wheel to become less dished when it spins.

FIG. 13 shows another (1300) sanding disk having flaps, where the flaps of abrasive material 1301 are interrupted by the apertures 1302. This gives the work surface a series of rest times and assists in cooling. FIG. 14 is provided to show that holes may be placed at various distances from the centre of the flapper disk, and preferably they are arranged so that the innermost perimeter of an outer hole 1401 is closer to the centre than the outermost perimeter of an inner hole 1402, so that an operator can see through substantially all of the disk when using the tool. The holes 1403 (though not essential) are here provided for imposing a weakened zone. Generally though the flaps will be torn off if overstressed. Alternatively or additionally a clutch or shear pin arrangement or the like can be provided (FIG. 13). Similar holes could be used in the contact-adherent system of FIG. 15, where a sticky (or "Velcro" fitted) disk 1501 is stuck down over its entire surface onto a disk 1502.

MOUNTING THE DISK ON THE BACKING PLATE

Backing plates can be provided with a built-in thread matched to that of the arbor of the angle grinder. In that case they can also be provided with holes to engage with a tightening spanner. Backing plates can be provided with perhaps 3 to 7 stubby projecting pins that engage with alignment apertures stamped through sanding disks. Examples are shown in FIG. 8 which shows a backing plate seen from the side, with projections 805 aligned with similar-sized apertures 806 in a sanding disk 803. (FIG. 23 shows another system). This avoids the need for a separate, fittable and then removable locating pin like 603 (which may become lost), and the stubby pins, which are not long enough to reach the work surface during use, also serve to lock the disk to the spinning packing plate during use. They transfer the torque from the arbor, via the backing plate, to the disk. In the event of excessive torque, the stubby projecting pins may break off, or the sandpaper, otherwise only retained on the arbor but not otherwise locked in rotation to it, may come out of alignment with the stubby projecting pins.

Where backing plates include gaps to overlay sanding disk apertures, they can be made with gradual trailing edges so that if a projection gets through a sanding disk it can tear out the edge of the disk and escape from the backing plate, probably causing a jerk to the angle grinder but at least not continuing to be trapped. FIG. 9 shows this, along with a raked edge 904.

RESILIENT BACKING PLATES for FINISHING WORK

One preferred type of backing plate comprises a thick, foam-filled (so that it is soft and resilient) backing plate, typically 24 mm thick and 200 mm in diameter. This is used in conjunction with adhesive-backed disks of sandpaper, and the combination is widely available and generally used for automotive finishing work. We modify the backing plate according to the theme of the invention so that it is fitted with a number of apertures—for (in combination) cooling and viewing purposes, or just for cooling purposes, and we cut channels or indentations in the surface of the backing plate so that the risk of a protruding object gripping the trailing edge of an aperture in a spinning disk is minimised. FIG. 7 shows one system for cooling channels. FIG. 22 shows relevant diagrams; a fitting plate 2301, a typical pre-cut sanding disk 2320, and the front surface of the backing plate 2310.

A fitting plate for use with our modified foamy backing plate includes one or more locating pins 2302 placed so as to mate, when in the correct orientation, with locating holes 2312 constructed within the foamy backing plate 2310 and to be fed through holes 2322 in the sanding disk, which is placed, abrasive side down, upon the jig or fitting plate 2301 prior to the above mating of locating pins with holes. Optionally, retaining clips may be used on the jig in order to hold flat any sheets which may tend to curl. When locating a sanding disk that can have (or preferably has) only one orientation to the backing plate, it is preferable that one locating pin is longer and preferably thicker than the rest. There are also preferred trough-forming projections 2302 located upon the fitting plate 2301 at positions corresponding to the trailing edges of the larger viewing/cooling apertures in the disk 2321 and the backing plate 2311 (these holes preferably being raked as shown at 2316 and 2336). The projections push the covering parts of the sanding disk into recesses provided in the backing plate. (The disk preferably has slits 2323 cut on the trailing side of the larger apertures to allow for this distortion). Once the backing disk is located on the locating pins the disk can be pressed down against the adhesive surface and the viewing/cooling apertures will be placed in substantially correct alignment. The fitting plate is then pulled off. As a result of the deformation of the sanding disk at the sites of the projections 2303, the sanding disk is provided with pressed-in abrasive material on the raised-from-the work trailing edge of the larger apertures, to assist in minimising the risk of catching a protruding object during use. In addition air flow over the work originating from turbulence caused by the viewing/cooling apertures assists in keeping the cutting cool.

Further to this, we also provide a striker plate or attachable fittings that retain the sandpaper in position inside the troughs 2313 by gripping the bent-inward portions of the (usually) adhesive disk between the fitting and the backing plate. These fittings 2334 may simply clip into place using inherent shape and resilience, or they may be held in place with fasteners, such as screws 2331. The fittings may also include projections 2332 which rise above the surface of the foamy backing plate 2330 on the operator's side and act during use may act to enhance airflow down the apertures and towards the work surface. Hence the abrasive surface 2333 is cooled, while the operator has some chance to see the work through the same holes. (These air scoop formations are concealed from the operator by remaining beneath the guard of the angle grinder).

GUARDS

There is a small risk that the sanding disk of this invention, being less concealed by a backing plate, may inadvertently cause deeper injuries than prior-art sanding disks if inadvertently brought into contact with a person. Therefore we have given consideration to guards, and FIG. 20 shows some designs. A preferred guard 2003 is mounted on the angle grinder body 2001, and comes forward over the sanding disk 2004 as far as is necessary to provide protection. A preferred mounting site employs the threaded holes provided for the handles 2002, for these tend to be standard features between different types of angle grinder. Generally holes are provided on each side (as shown) but the operator has only one handle to be put in one side or other depending on handedness. The guard 2003 may be held between a handle and the body of the grinder, or it may be held in an un-used hole by a bolt. (The handle may be placed on the right or the left side according to the handedness of the operator). A guard may be made by pressing or forming so that lugs 2005 are bent upwards from the plane of the guard. A side view of two versions is shown at 2014; the lower one has at 2006 a slotted hole so that it can be moved forwards or backwards. Preferred guards are transparent, so that the operator can see through them and may be able to have the entire disk covered by the guard—yet still be able to see through the equipment to the work during abrasion. Another version is shown at 2015; this version is adjustable by means of a slot 2011, a wing nut 2012, and a pivot nut 2010, which allow the curved portion 2007 of the guard to move forwards and backwards relative to the angle grinder, onto which the guard is held by bolts 2008 and 2009 onto the brackets 2013 entering the handle mounting holes. (The handle may replace one of the bolts). 2016 is an optional trough on the other side, to allow more flexibility in adjustment.

Preferred guards are also capable of adjustment to and from the edge of the sanding disk, so that the amount of exposed disk can be optimised according to various working conditions.

In addition to the obvious safety considerations in favor of the provision of guards, there is an added advantage in that an appropriately shaped guard will help channel air flow generated during grinding and ensure that swarf produced is ejected with the radially outwardly, even when the air turbulence generated by the viewing apertures, especially as sculpted in accordance with a preferred feature of the invention, tends to draw air from the grinding surface back towards the operator. Any such material is swept away by the swirling air currents generated between the rotating disk/backing plate and the guard itself.

PREPARING DISKS FROM SHEET MATERIAL

Conventional disks, and particularly the sanding disks of this invention, are generally stamped out from stock sandpaper, generally comprising fabric or fibre-reinforced backing material onto which the abrasive grains have been attached by a suitable type of glue, supplied in rolls about 1.5 meters wide. The stamping act is carried out between dies in a press. Naturally there is a significant amount of wear on a die working with hard abrasive materials, and it is expensive to make even a simple circular cutting shape, let alone the more complex shapes of the invention. Assuming NZD $20,000 for a die suitable for this abrasive application, and a lifetime before extensive repair of 150,000 presses, one can see that the stamping cost per disk may be of the order of 5 c plus wages for the workers attending the machine and possibly the expense of upgrading to heavier presses.

Accordingly we propose to use, at least for trial runs, a liquid cutting process as shown in FIG. 21, in which a fine jet of water (or some other suitable liquid) forced out of a nozzle at a high pressure is used to make precise cuts in a sheet of stock sandpaper in order to prepare sanding disks. (We understand that certain liquids are more beneficial to standard sandpaper stock; these may be used as the cutting fluid. In addition, abrasive granules may be added to the water stream as is practised in the art (but see below). In more detail, the liquid cutter would, as is customary in water cutting techniques used in other fabrication processes, use liquid raised (in the supply pump 2103) to a pressure of perhaps some 30,000 pounds per square inch pressure, brought by means of a flexible hose 2104 to ultimately emerge from a nozzle 2105 close to the material to be cut. There is preferably some means of controlling the flow, such as a pressure relief valve or a bypass valve, so that the nozzles can traverse the stock material without cutting (as in order to reach a hole position). Spray and waste is collected, preferably actively with the aid of air jets and vacuum cleaners (not shown) and the fluid may be filtered well and re-used. The nozzle is moved relative to the stock by computer control, preferably to a precision of ±0.1 mm over the width of a single sanding disk, although a precision of ±1 mm might be sufficient.

In one embodiment the sheet of stock coming off a roll 2101 may be moved forward and backward by gripping rollers 2109, one steel and one (against the abrasive side) of rubber, to cause movement in one orthogonal axis, and the nozzle or nozzle array 2105 may be moved from side to side on a rail or some other suitable support, in the other orthogonal axis. Stepping motors (2106, 2107) coupled to rollers 2109, 2108 represent one preferred source of motive power since they are easily coupled to a computer-based controller 2110 by known interfaces. The HPGL plotter language (or similar) might be selected as a standardised way of instructing the stepping motor interfaces. Preferably the unit step size of the stepping motors in both axes is similarly related to relative work/cutter movement so that when a circle is intended, it is obtained. (Software can compensate for constant errors of scale, so the above requirement is simply a preferred feature). Preferably a number of nozzles 2105 are held in a gang formation on a rigid beam or on a rigid plate 2113, so that a number of identical disks 2102 can be cut from the stock roll in one set of controlled movements.

FIG. 21 does not show the details of a practical machine. For example, the lengthwise movement of the stock should preferably involve a low-resistance, low-momentum action and (as in reel-to-reel tape drives for computers) a loop of material may be drawn off and reduced or lengthened as forwards or backwards movement occurs. In FIG. 21, the roller 2118 could be relatively lightly spring-loaded so that it tends to push up. Motors such as 2117 driving the rolls are useful to reduce drag on the rollers 2109 at the cutting machine.

The addition of abrasive to the liquid jet may not be necessary if the machine is made so that the jet first hits the abrasive side—for then that abrasive acts as the cutting abrasive.

It may be possible to prepare a stack of sanding disks 2111 in one pass from a multi-ply stock sheet. The effectiveness of this may be highly dependent on the coarseness of the grit and the thickness of the backing material being cut. That is, too many layers will exceed the capacity of the cutting jet to make clean cuts. FIG. 21 shows an additional roll 2116 behind a first roll 2101 and possibly further rolls of stock can be added. Or the stock may be wound as a multi-ply single roll.

Of course, laser cutting may be used as an alternative (wherein an infra-red transmitting lens for focusing radiation to a point; the lens being coupled to a carbon-dioxide continuous wave laser, replaces the liquid nozzle, but we understand that this is more expensive and takes more skill to use and maintain the laser(s), and there will be noxious fumes to dispose of, arising from the backing material and glues.

Sanding disks tend to curl up when packed and they are prone to deterioration if water gets into the backing material, particularly during storage. It tends to do this from cut edges. (This is a possible disadvantage of water as a cutting liquid. Therefore, the cutting liquid may also be provided with sealant properties. It may be a meltable solid, such as a wax—that is molten when it is used as a jet. Some that sets over the sanding disk, where it can then can act as a lubricant during use. Or it may be water or a watery liquid including some dissolved material that acts as a varnish, or as a sealant. Or it may be a polymerisable material such as a polyurethane paint.

The advantages of CNC (computer numerical control)-based liquid cutting include that it is now trivial to prepare and manufacture a new design of sanding disk of virtually any shape (2112 represents a set of cutting co-ordinates), without the substantial expense of fabricating a very hard die, wear is substantially limited to (replaceable and mass-produced generic) liquid nozzles rather than to re-sharpening and re-surfacing entire pattern-specific dies, and there is a possibility of the cutting sequence first preparing useable and recoverable flap shapes (style: 2114) from within areas destined to become waste, and then cutting out the disks. Perhaps a retractable arm can catch the flaps and lift them from the cutting area. The illustration shows 15 flaps at 2115 made from the otherwise waste stock around a single example apertured and gapped sanding disk. Most sanding disk shapes occur in the libraries of typical computer drawing packages. Of course economy in cutting strokes leads one to prefer those shapes of sanding disk that include straight (or other) edges common to more than one disk, as shown in the example set 2112 which would result in very little waste, especially if flaps 2115 are cut from the inter-disk diamond shapes and from the larger disk apertures also.

The path of the cutters may be programmed so that all removed material is shredded finely. When gathered up and filtered, this material can be used in the manufacture of grinding wheels of various types. In any case there will always be some finely divided material recoverable from the fluid drains of the cutting machine.

Fluid cutting is less likely than pressing to initiate stresses at the time of manufacture at a sharp corner or blind end of any cut other than a circular outline. (Cracks are expected to tend to propagate from stresses arising at corners).

The preferred anti-snagging shapes to be provided about the trailing edges of the apertures cut through our type of sanding disk by creating a raised "hood" over each hole are preferably created in a separate pressing step to the cutting step, whether the cutting step uses dies or otherwise.

It should be emphasised that the fluid cutting method of preparing sanding disks is also applicable to conventional sanding disks, that is, circular shapes with perhaps a central, concentric mounting hole and no other.

FIG. 22 shows some other possible layouts for sanding disks though it is impossible to show all options. Presumably optimisation can be varied according to relative costs. FIG. 22 shows, at 2202 a single aperture disk, having a balancing segment removed from its periphery, and a mirror image at 2203.

The sanding disk 2400 of FIG. 24 has (a) three viewing and principally anti-snagging apertures 2403 (which have been drawn to show the limits of the preferred recess made by pressing the material of the disk inward, and (b) three drive/alignment holes 2401, at about the same radius as a tear-out zone 2402. Preferably, all three of the drive/alignment holes are driven by means of corresponding pins held in the backing plate. The sanding disk, when connected to the drive pins, is in correct alignment on the backing plate. If the disk is, in use, exposed to too great a stress the drive pins will destroy the tear-out zone 2402, so that the disk will come free of the backing plate and the disk can no longer be driven.

In FIG. 25, 2500 is the assembly, 2501 is a central register plate on the backing plate, 2502 is the sanding disk, 2503 is a breakout zone on the sanding disk, and 2504 is a sanding disk to backing plate alignment aperture and/or pin. An advantage of this arrangement is that the procedure for putting a disk on the backing plate is simpler and easier.

An additional enhancement to the backing plates of this invention is to provide a grip pad 2602 for gripping the sanding disk by means of a nut pressing the disk between itself and the grip pad, inside the concentric tear-out zone. The grip pad 2602 is like a ring of sandpaper placed concentrically around the aperture provided for the arbor of the angle grinder. (In our prototypes, it is a ring of sandpaper glued onto the backing plate, but some other durable material which digs into the back surface of the sanding disk may be used instead—such as an insert of a knurled or deeply etched metal, or a portion of a plastic surface incorporating projections. The projections or rough surface may not be necessary. Spigots on a metal washer are one preferred formation of a roughened surface. A simple metal washer may suffice, if the disk is tightened sufficiently against it. This concentric ring is intended to grip a sandpaper disk (such as FIG. 24) inside its tear-out hole zone, so that if the disk in use is exposed to too great a stress it will come free of the backing plate which can no longer drive the disk. Another advantage of this ring (as shown in the section 2600) is that the slight elevation of the gripping surface 2602 provides further air movement between the sanding disk and the backing plate 2603 during use, so cooling the rear of the sanding disk.

In our opinion the grip pad and the drive pins are preferably not used together; though this opinion depends on the relative effectiveness of each construction as it is implemented in a commercial embodiment.

FIGS. 27 to 30 show a contact sanding disk and a backing plate suitable for use with such a contact disk. This type of disk is used particularly for finishing work on automobile bodies, for producing a smooth surface on or under painted layers. The user of this kind of disk is faced mainly with the problem of securing a long disk life before it gets clogged up, which requirement can also be expressed as the problem of keeping the disk and work surface cool during sanding. We have discovered that a good vacuum can be created within the relatively thick body of the backing plate during rotation, by making channels (see FIG. 7; 706) which run substantially centrifugally, so that air is flung out from them and extracted from apertures (such as 2803 or 2905) passing through and near the centre of the contact adhesive disk. These apertures may also serve as locating or aligning holes. If the pins used projected right through the backing disk, it may be preferable to seal off those holes with a flap of a resilient material, so that the effects of the vacuum are concentrated on the abrasive surface. Preferably the channels are exposed when the sanding disk is removed, so that accumulated debris can be flushed out.

FIG. 27 simply shows the rear (operator's view) surface of an unmodified backing plate having a nut 2701. Air extraction (vacuum) channels are not shown. FIG. 28 shows a three-hole version 2800 of a contact sanding disk with (a) vision/cooling apertures 2801 in three pairs of two, (b) indexing/alignment holes 2803, (c) fold lines 2805 about a cut 2804, and (d) vacuum and alignment apertures. Note that in this version the pairs of vision/cooling apertures 2801 are arranged to be not on radii of the disk. The cuts 2804 allow the abrasive material to be deformed inwards against corresponding depressions within the backing plate (see FIG. 23) and striker plates running along the line joining the apertures 2810 may be installed. FIG. 29 shows another version of a contact sanding disk with the 22 mm diameter vision/cooling apertures aligned along radii, (b) 8 mm diameter vacuum/alignment holes, and (c) fold lines.

FIG. 31 shows at 3100 the four-sided sandpaper disk 3101 in position upon (behind) a backing plate 3102. Note the alignment (any one of 4 positions) of the viewing/ventilation holes in the sanding disk behind the raked holes of the backing plate.

FIG. 32 shows the work surface side of a backing plate 3200 compatible with the sanding disk of FIG. 30. This plate has a grip pad 3203, four cooling channels (3201), four structurally weakened breakout zones (holes 3202) in case some object projects through the viewing/ventilation apertures, and four index alignment apertures.

FIG. 33 shows a backing plate 3304 in section and a matching four-sided sanding disk 3300, having four viewing/ventilation apertures with anti-snagging features 3303, thinned break-out zones 3301, and a concentric weakened or tear-out zone inside the alignment holes. The sanding disk also has wing tips 3302 (see above).

We estimate that a manufacture of four-sided sanding disk, where material has been removed from the circumference, can involve a saving of at least 15% of the raw abrasive material over conventional circular disks, because the cutting lines used for circular disks do not touch and there is a reasonably large amount of un-used material lying between circles. In contrast, a single cut can separate adjacent square-sided disks. There is a little waste material where the corners of the squares have been radiused; but this is relatively small.

Figure 34:
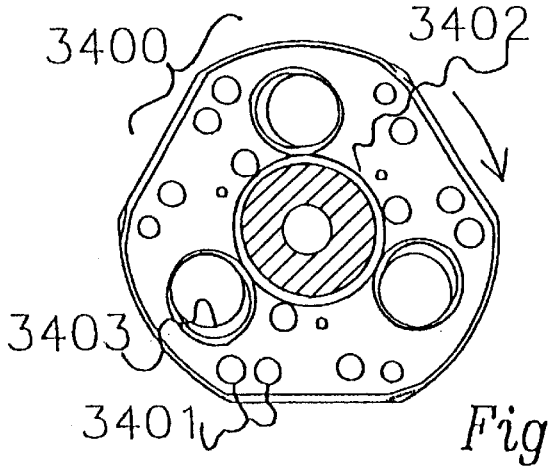

FIGS. 34 to 37 show a three-sided sandpaper disk; similar to the above four-sided version. FIG. 34 shows a disk in position upon a suitable backing plate 3400. One of three large viewing and ventilation holes, provided with an anti-snagging features, is at 3403. In case some object catches within this aperture during use, holes 3401 give the backing plate a weakened zone so that it can let the object through. (We should say that we find it almost impossible to make an object catch in the holes of a spinning disk; the most likely circumstances are when the disk is spinning only very slowly).

Figure 35:
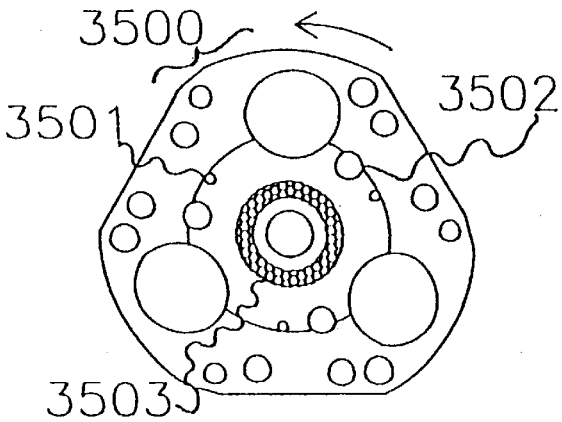
Figure 36:
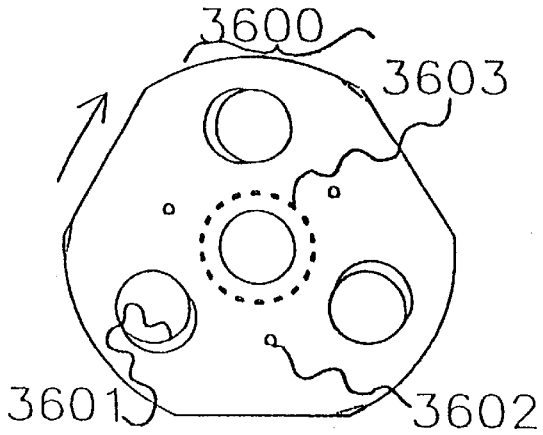
Figure 37:
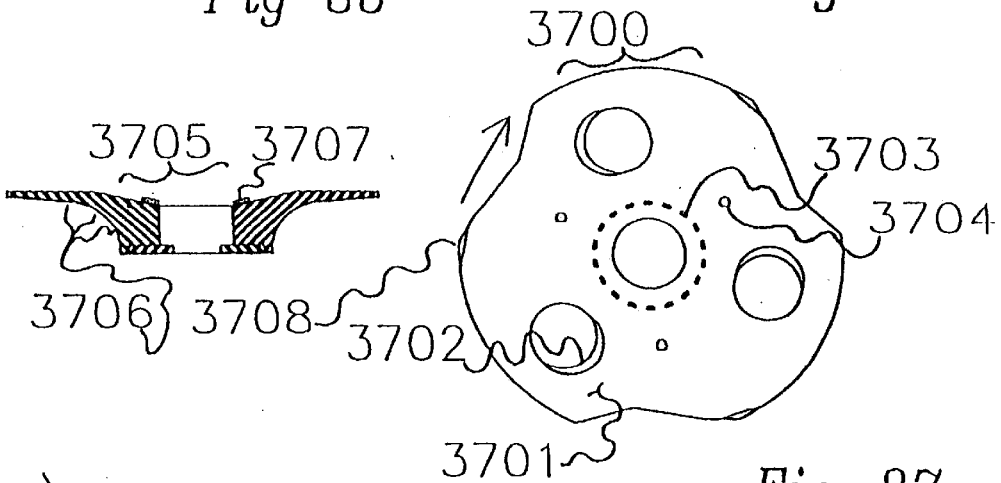
Figure 38:
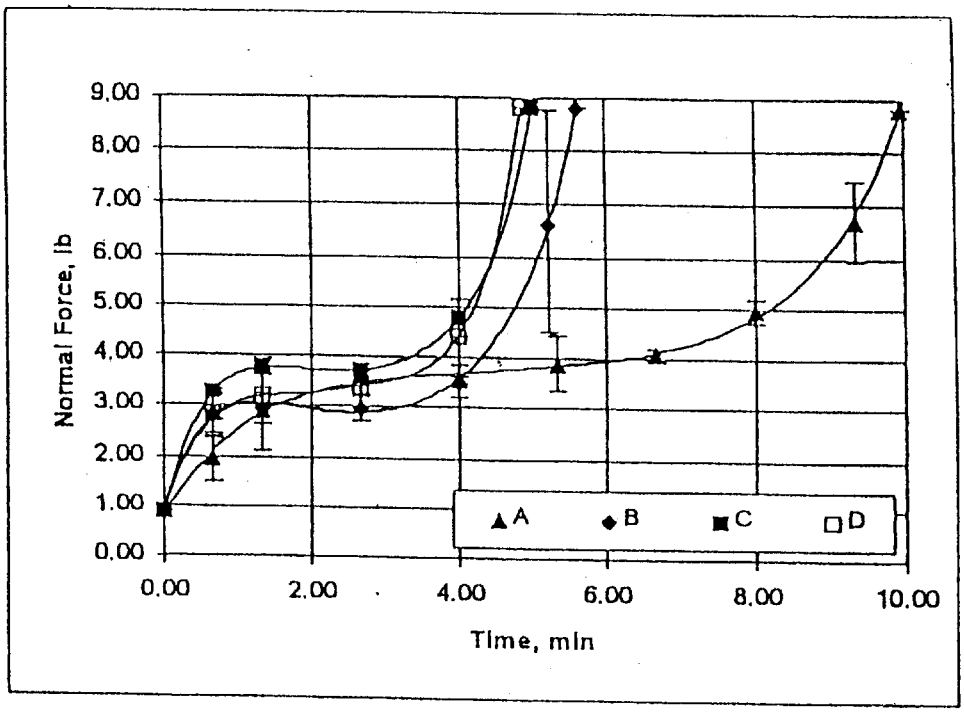

FIG. 35 shows a backing plate 3500 compatible with the sanding disk 3600 of FIG. 36, having a grip pad 3503, and index alignment holes 3502. FIG. 36 shows a three-sided sandpaper disk 3600 with (a) wing tips (not labelled), (b) ventilation/viewing holes 3601 fitted with anti-snagging features, (c) a concentric tear-out hole zone near the central aperture, at 3603, and (d) alignment holes 3602. FIG. 37 shows a backing plate in section (3705) and a matching three-sided sanding disk (3700), having ventilation holes 3702 with anti-snagging features, break-out zones 3701 on the trailing side of the ventilation holes, and a concentric weakened or tear-out zone 3703. Alignment holes are provided at 3704. The backing plate 3705 has a grip pad 3707—like a ring of sandpaper—intended to grip the sandpaper disk concentrically inside its tear-out hole zone. The area 3706 is provided with apertures for promoting air circulation for cooling the working area during use. Wing tips are again provided and drawn, as at 3708.

Wing tips or deliberately formed vanes (either on the edge of the sanding disk, or made from the material of a backing plate) or even simple deformations of the edge of a resilient backing plate may be used to entrap air about the circumference of the sanding disk. These may be used in conjunction with an air containment "skirt" around the guard of the angle grinder and projecting towards the work surface, the skirt being made of a soft and preferably transparent resilient material (such as polyurethane) and including a positioned gap placed so that dust is ejected in one direction rather than in all directions. A dust collecting device can then be installed so that a substantial proportion of the dust is retained. This type of guard is designed for use with the thick, resilient backing plates intended for use with contact sheets of sandpaper and for use in applications such as automobile bodywork finishing; in manufacture or repair.

EXAMPLE

Figure 6:
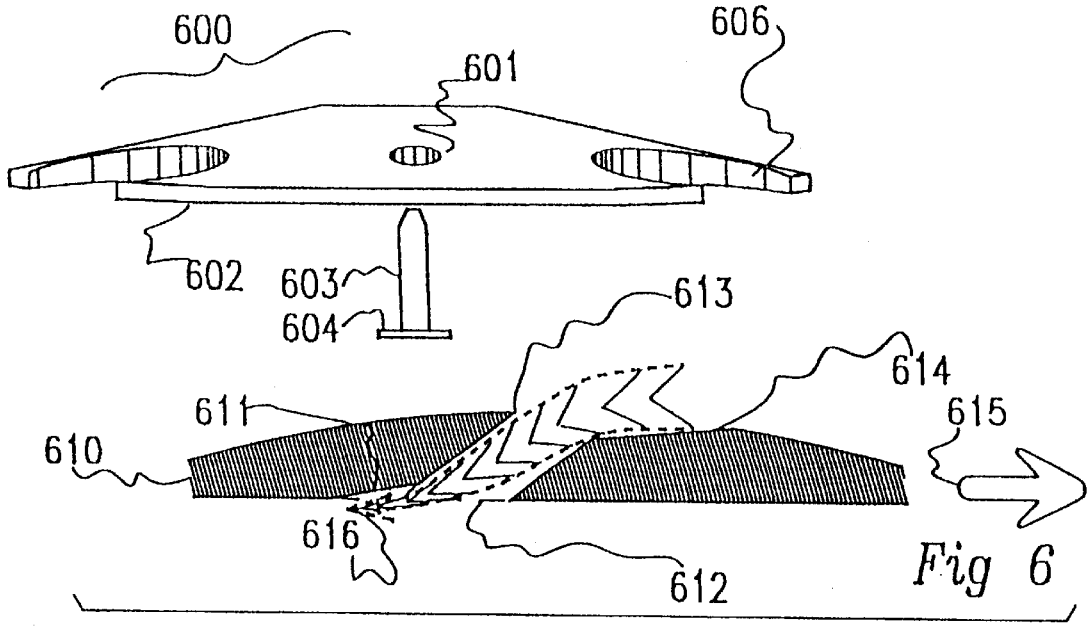
Figure 7:
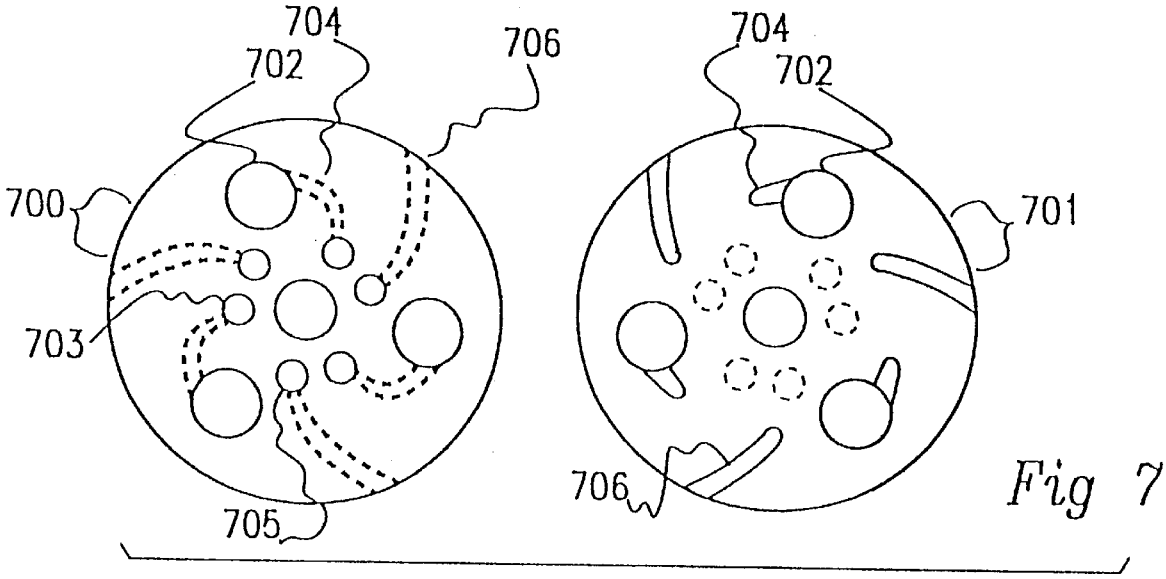
Figure 8:
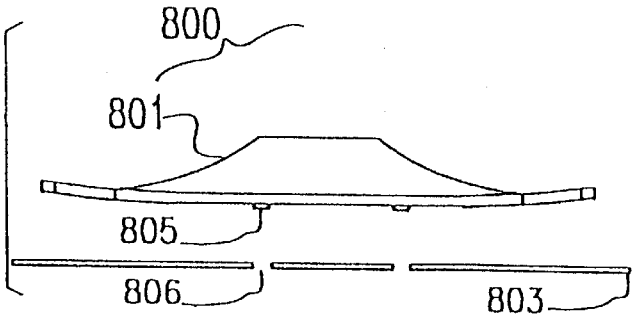
Figure 9:
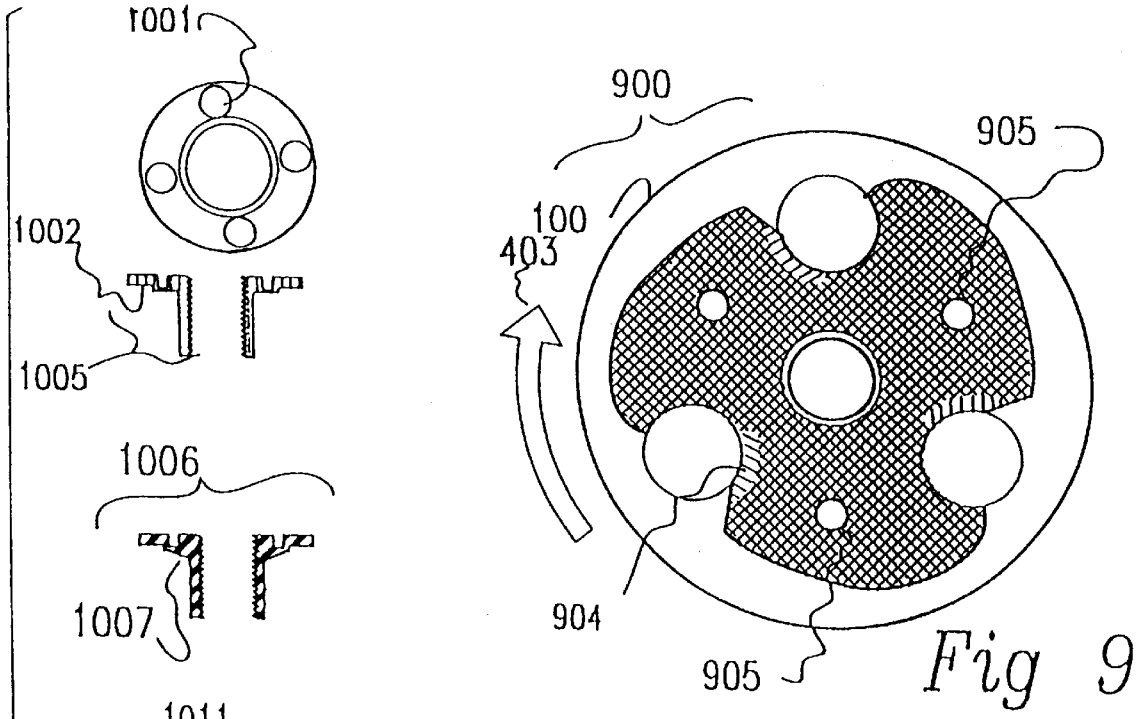
Figure 10:
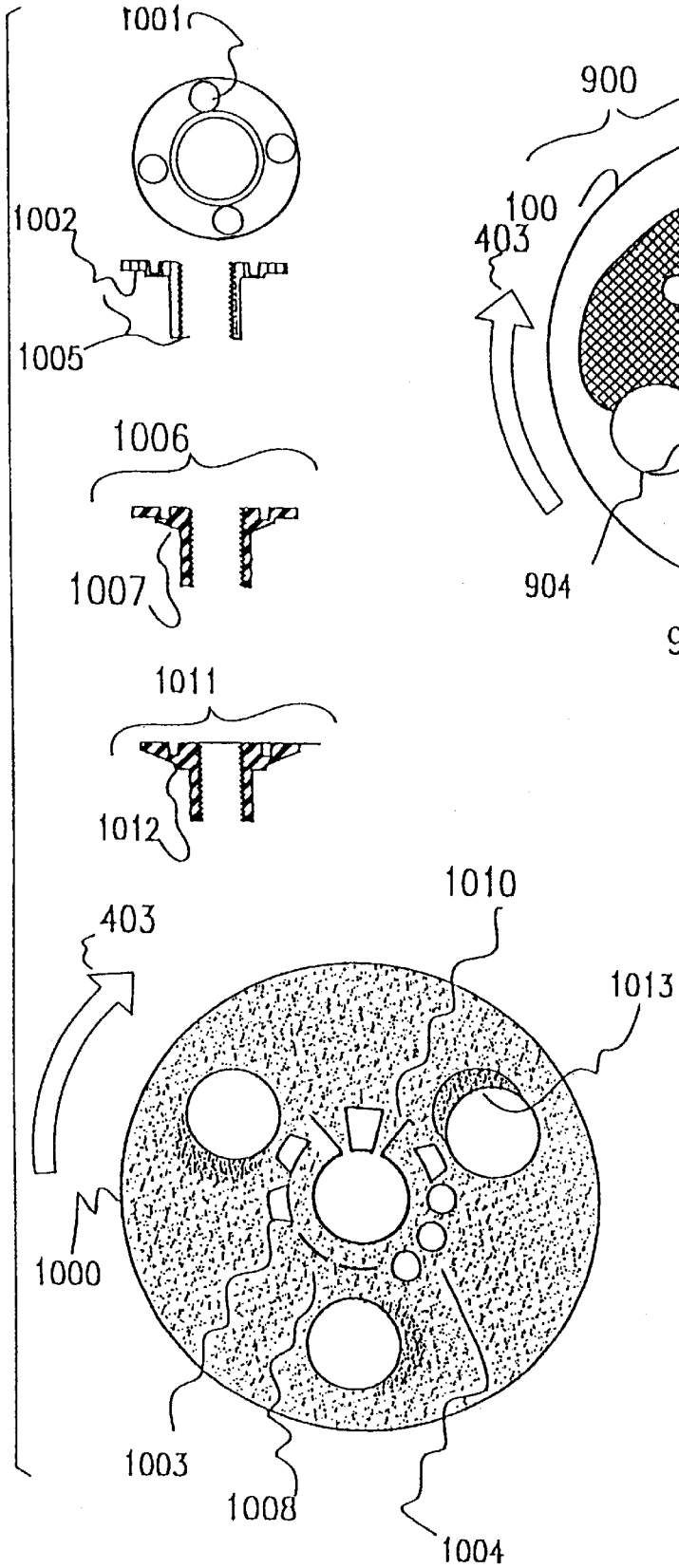
Figures 16, 17, 18, 19:
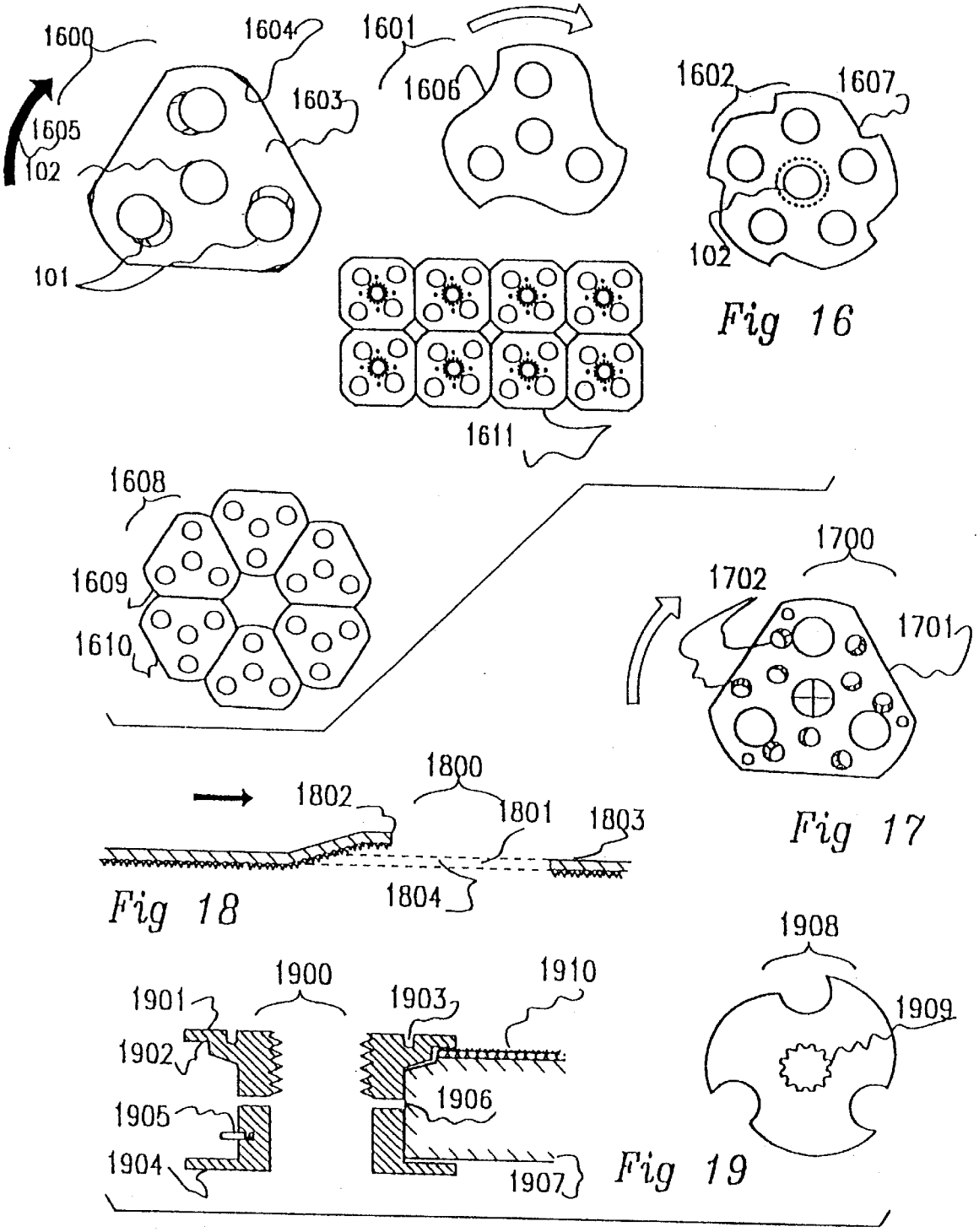
Figure 20:
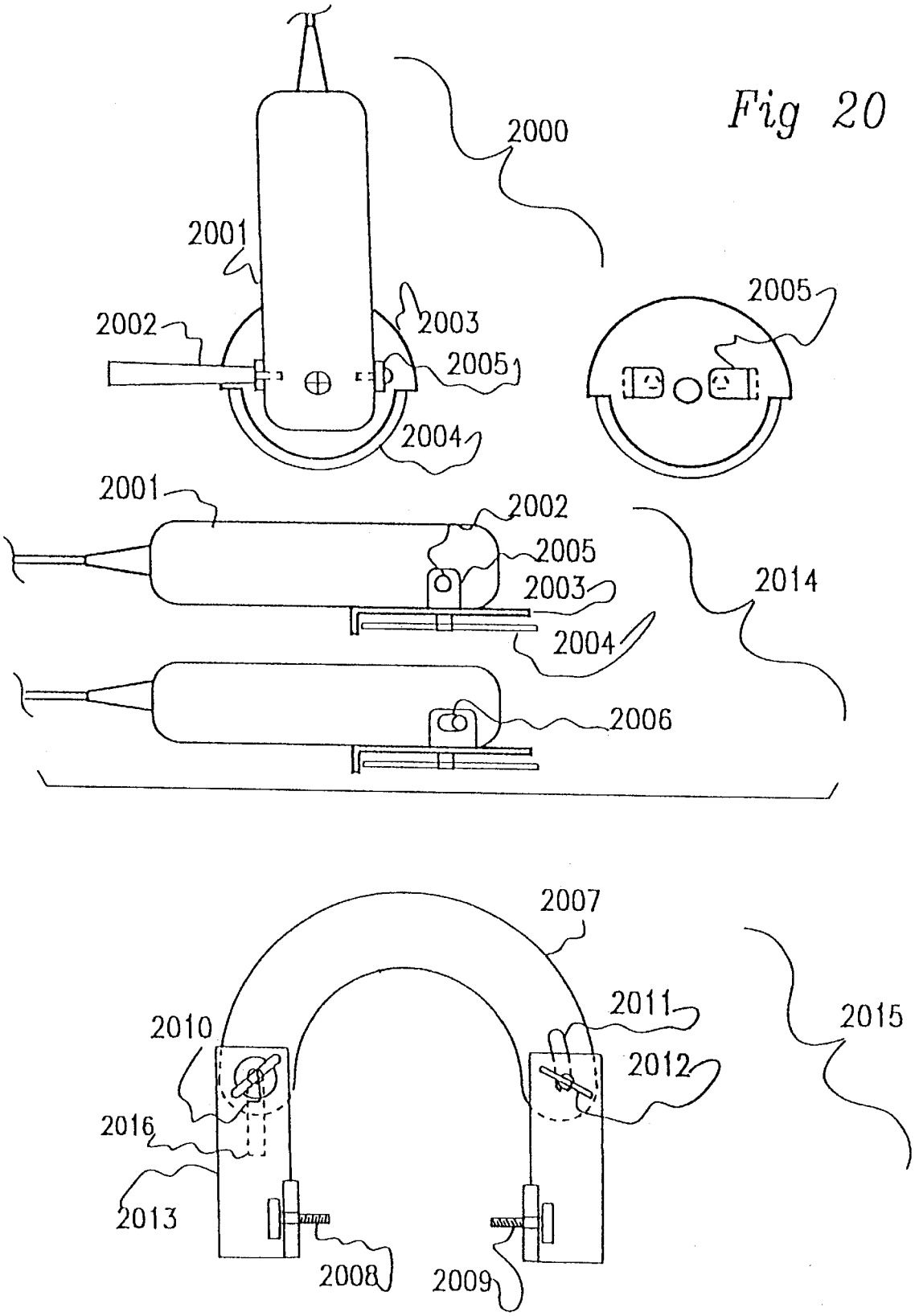
Figure 21:
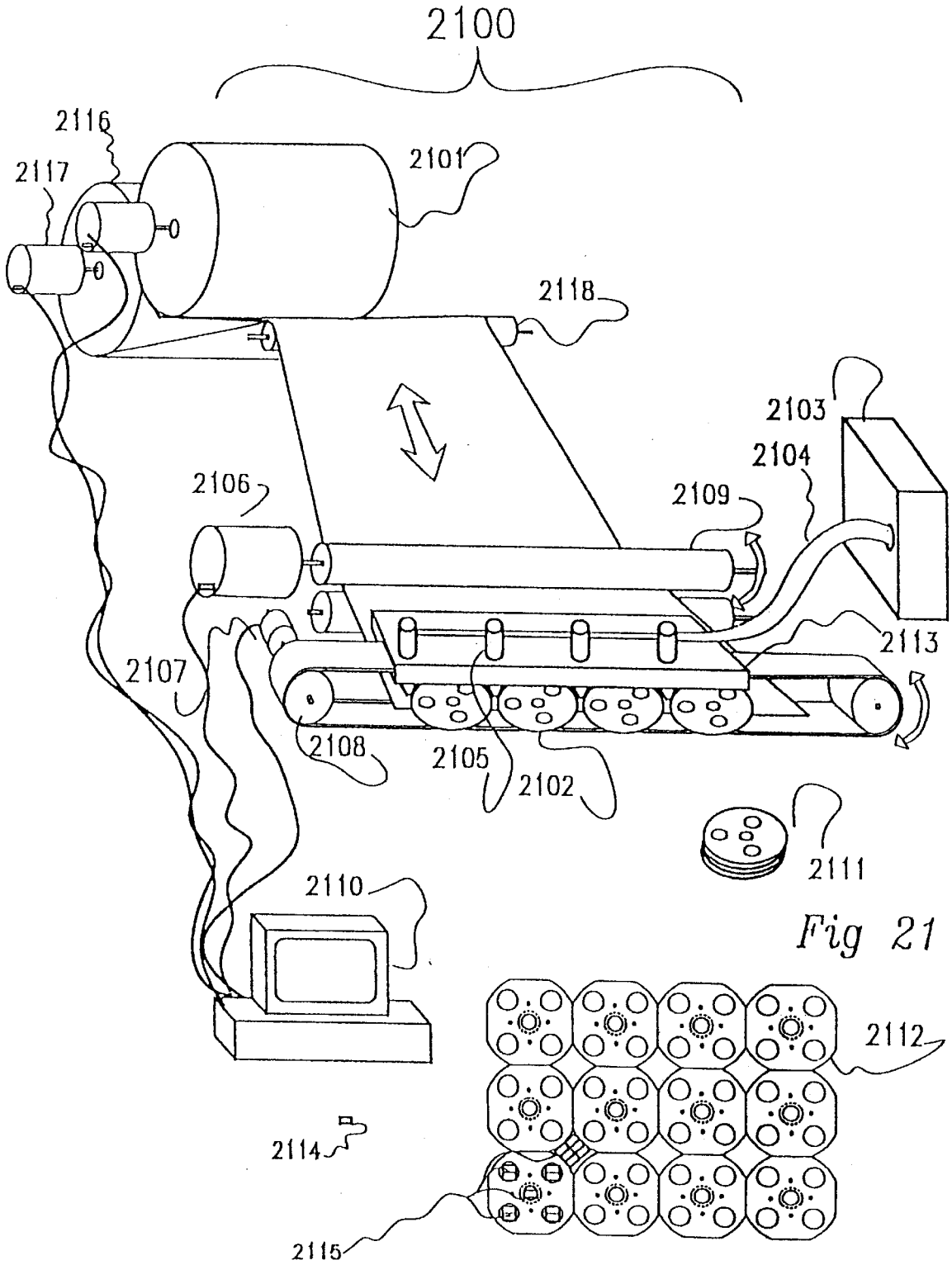
Figure 22:
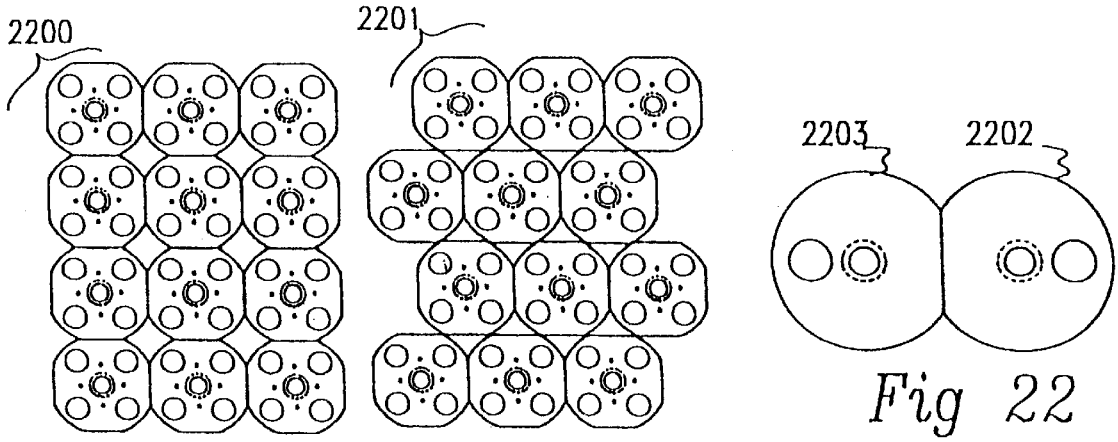
Figure 23:
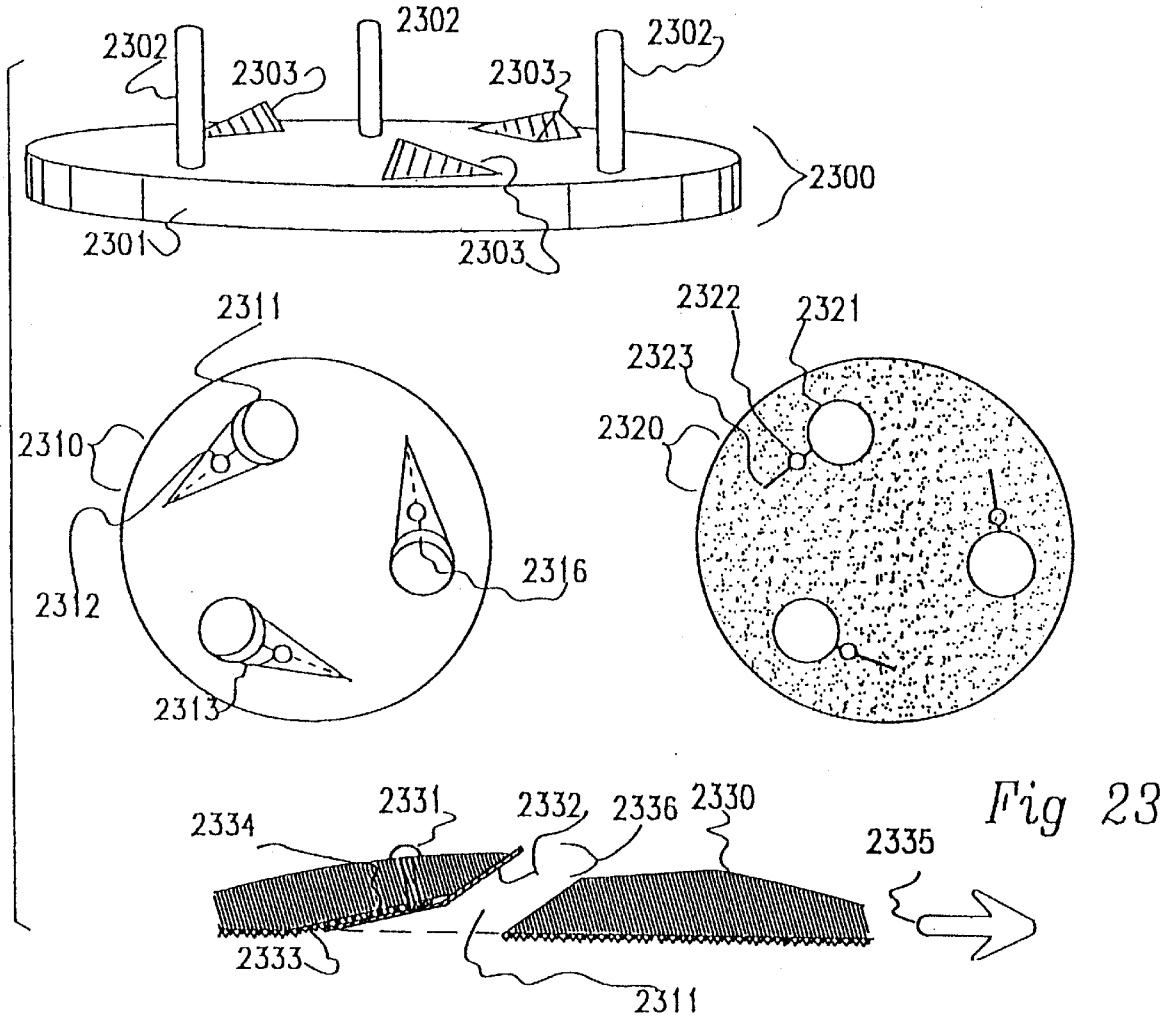
Figure 24:
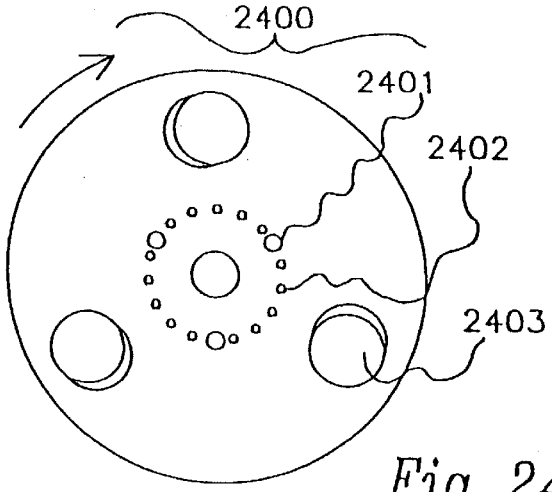
Figure 25:
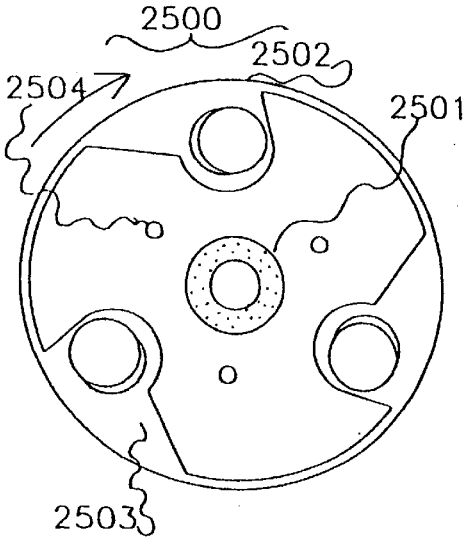
Figure 26:
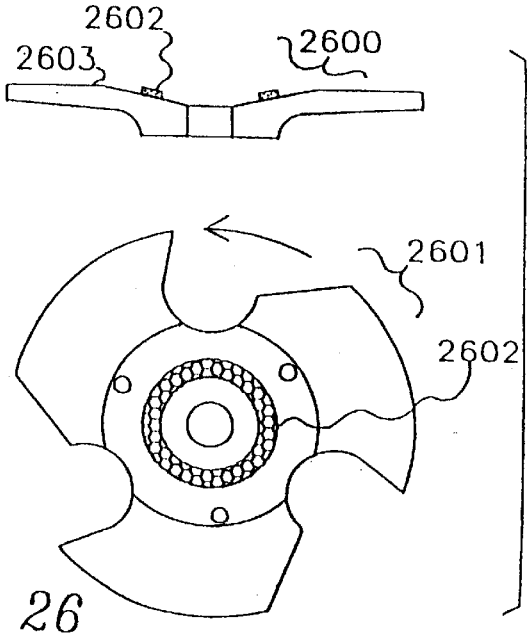
Figure 27:
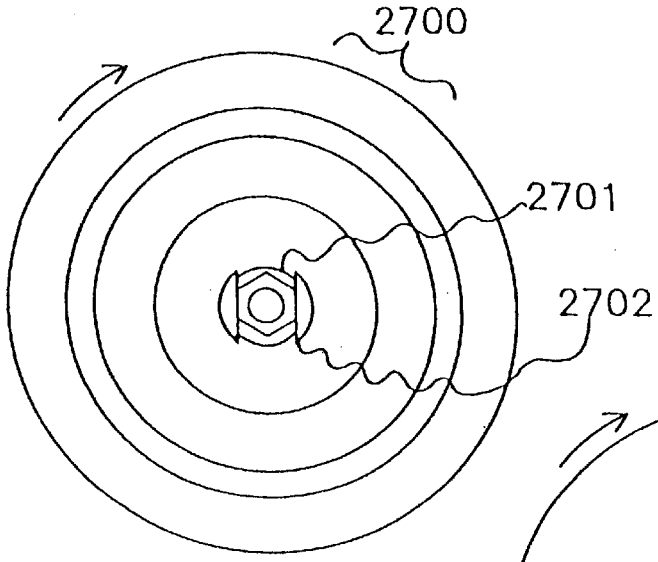
Figure 28:
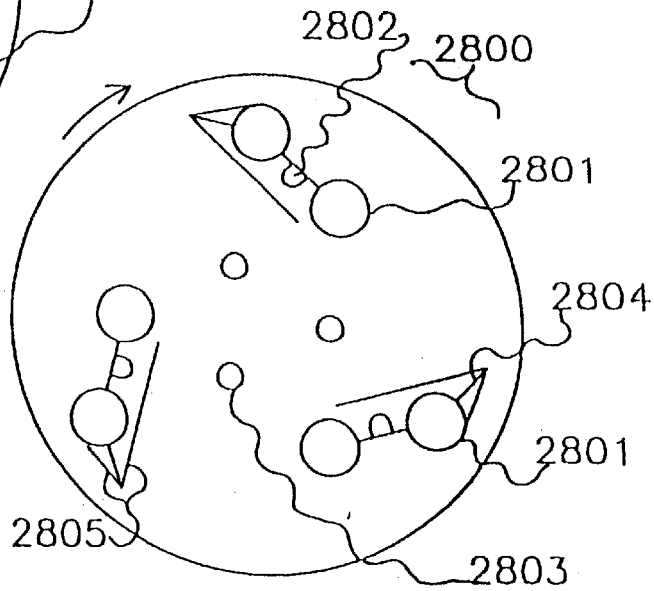
Figure 29:
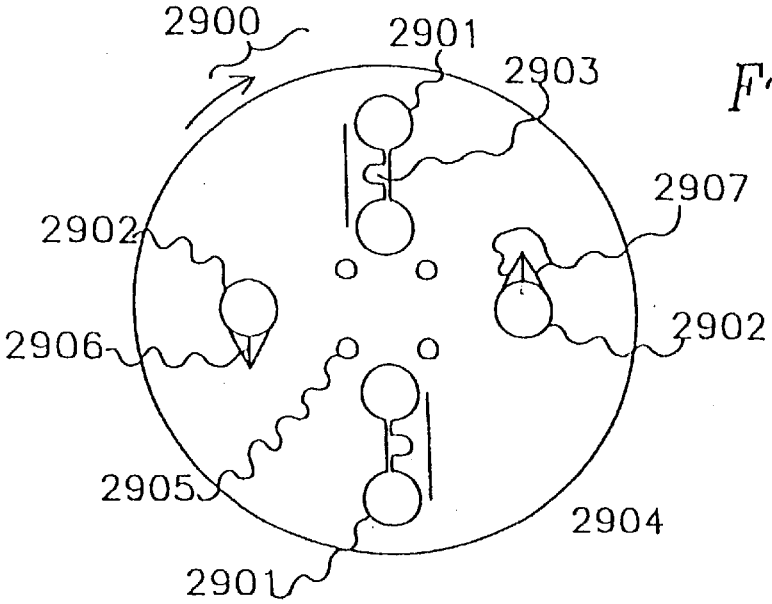
Figure 30:
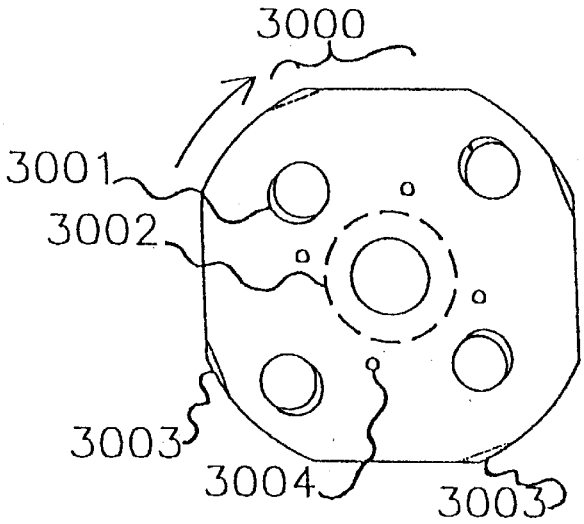
FIGS. 30 to 33 show a four-sided sandpaper disk system. The disk 3000—FIG. 30 has wing tips 3003 which help increase air flow between the disk and the material being abraded, as well as reducing the impact of rim contact, four 16 mm diameter viewing holes 3001 which are the primary source of ventilation, and a central tear-out hole zone 3002, inside an array of alignment holes 3004.
Figure 31:
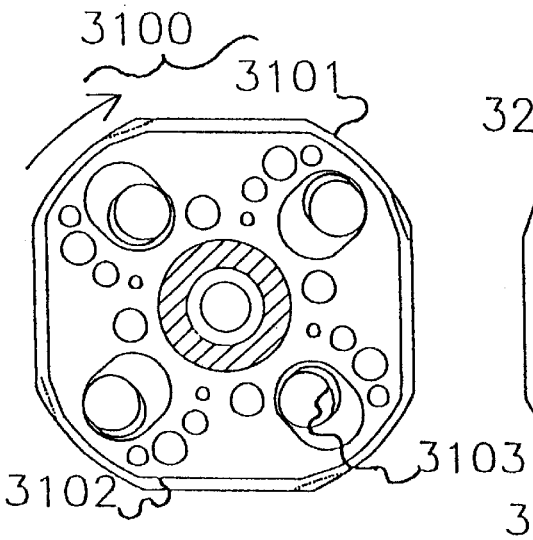
Figure 32:
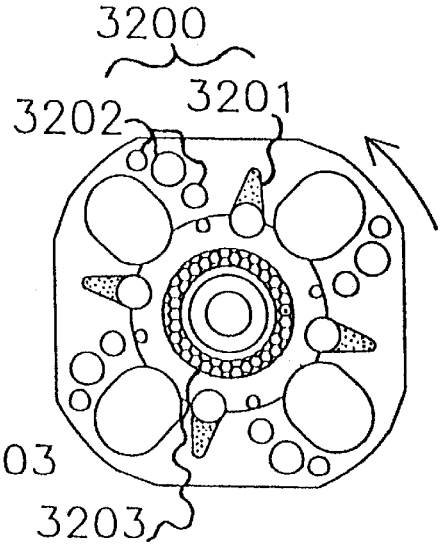
Figure 33:
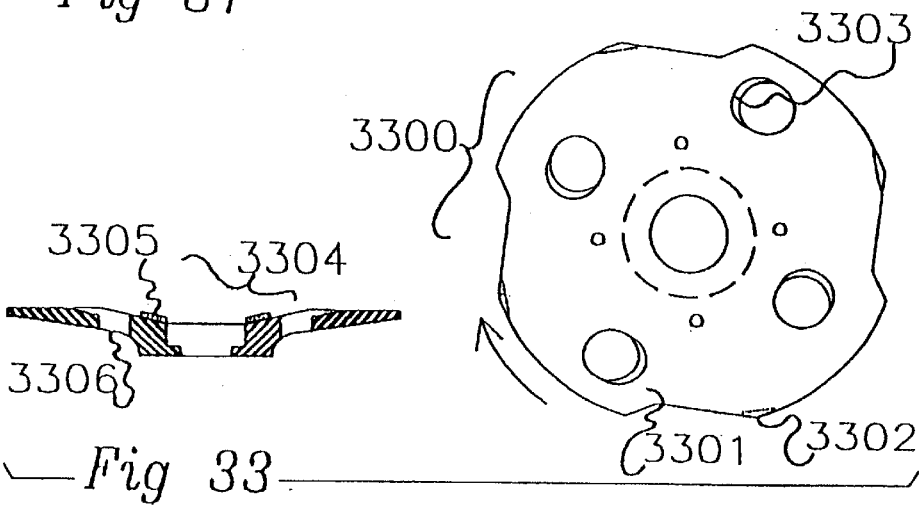

In this Example the advantages of the disks in which chord segments are removed to produce an abrasive disk. In this Example, four disks are compared for grinding performance. The first disk, (D), is a prior art disk with a diameter of 11.4 cm (4.5 inches) with a central mounting aperture used in the typical prior art fashion with only the outer periphery actually used for grinding. This was done by having the area of contact on the workpiece overlap the perimeter. The second, (B) was identical to the D disk except that full contact was maintain with the full workpiece by moving the location of engagement between the disk and the workpiece to the same location used with the other disks. The third disk, (C), was an identical disk but modified to make it according to the invention by being provided with three viewing apertures as shown in FIG. 24 (2400) of the drawings except for the omission of features 2401 and 2402. The fourth disk, (A), was a disk similar to disk C except that chord segments were removed to provide a disk as shown in FIG. 16 (1600) of the drawings. The backup plates were of 2.54 cm thick aluminum with shapes similar to the disk shapes as taught in the specification. The abrasive surface was provided 50 grit fused alumina with phenolic maker and size coats.

The disks were evaluated using an Okuma ID/OD grinder used in an axial-feed mode such that the workpiece was presented to the face of the disk rather than an edge.

The workpiece used in each case was 1018 mild steel in the form of a cylinder with an outside diameter of 12.7 cm (5 inches) and an inside diameter of 11.4 cm (4.5 inches). The end surface was presented to the abrasive disk. The abrasive disks were operated at 10,000 rpm and an in-feed rate of 0.5 mm/min was used the workpiece was rotated at 12 rpm. No coolant was used and the workpiece was centered on the portion of the disk where the viewing holes are located in the embodiments according to the invention. The disks were glued to the backup plate and this unit was weighed before and after the testing.

To determine the reference point the workpiece was brought into contact with the disk until the axial force reached 0.22 kg (1 pound). Grinding was then continued from this reference point until the axial force reached 1.98 kg (9 pounds), which was taken to correspond to the end of the useful life of the disk. Thus the time of grinding between the reference point and the end point was considered to be the useful life of the disk.

The results are represented graphically in FIGS. 37–41. From FIG. 38 it can be seen that the rapid rise to a normal force of 9 pounds, which is taken to be the end point since at that point little metal removal is occurring since most of the abrasive grit has been removed or worn out, occurs at about the same time for all the round disks but substantially later for the disk A with the modified triangular shape. Indeed this disk lasted about twice as long as any other disk. This is counterintuitive since more of the abrasive surface has been removed.

Figure 39:
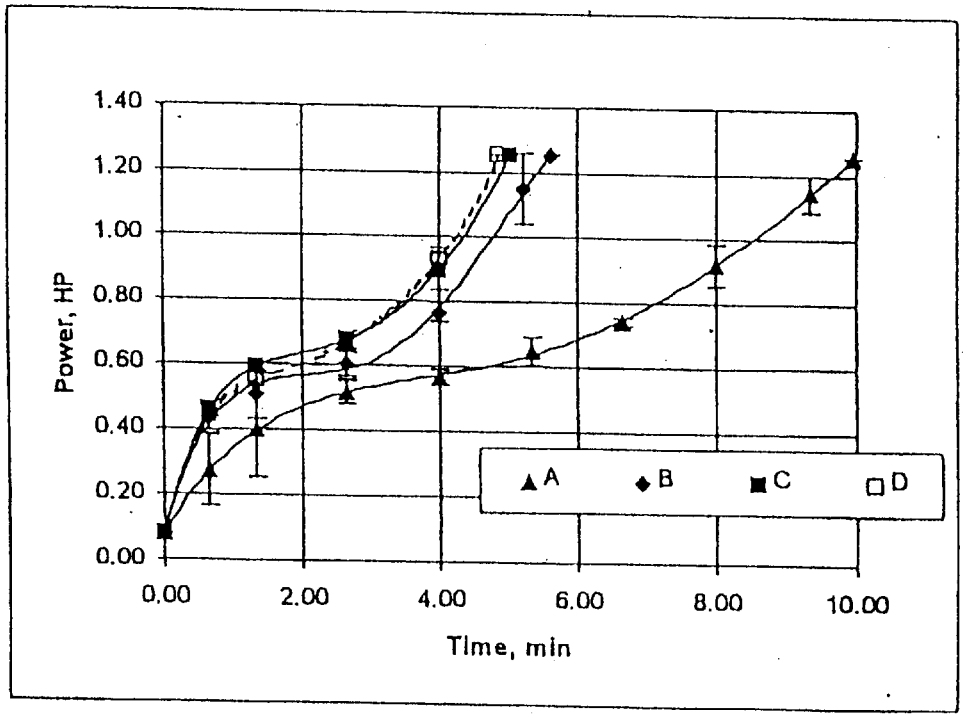

In FIG. 39, the power drawn by each of the disks was plotted as a function of time. This showed the same pattern as FIG. 38 with the disk A drawing significantly less power throughout the period when all disks were actually grinding. Thus disk D required less force and drew less power.

Figure 40:
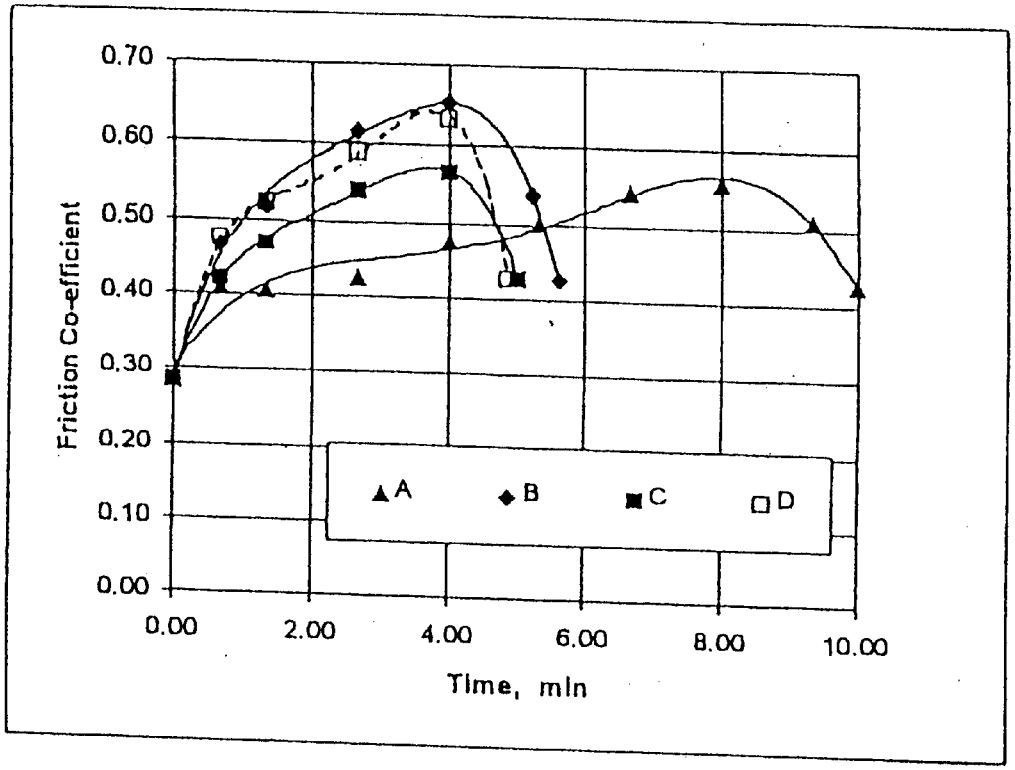

In FIG. 40, the friction coefficient variation with time is plotted for the four disks. Her separation develops between the round disk with the observation holes and the two prior art disks with a significantly lower coefficient of friction being observed for the disk according to the invention. However the lowest coefficient of all is observed with disk A.

Figure 41:
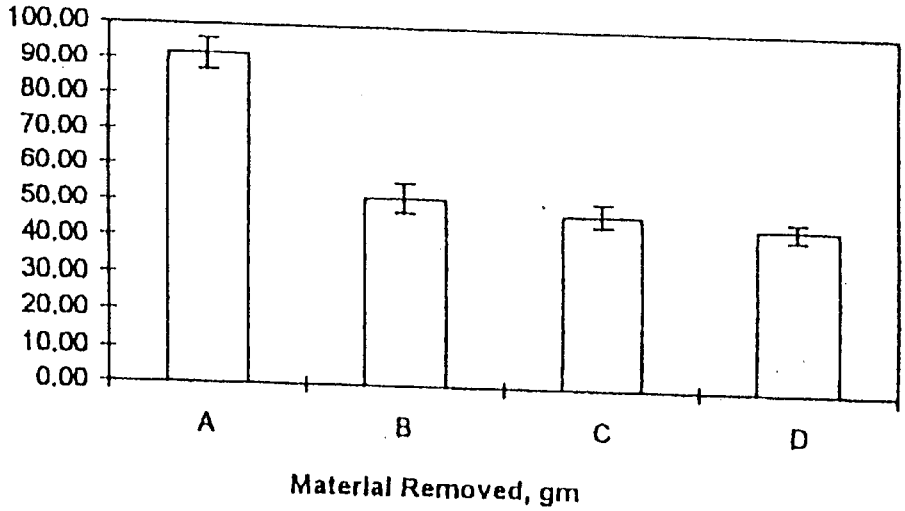

FIG. 41 compares the amount of metal cut over time by the four disks. This shows that disks B, C, and D cut about the same amount of metal over the periods of the test but disk A cut about twice as much.

Thus the disks according to the invention cut at least as well as the prior art disks while affording the benefit of being able to view the area being abraded as the abrading progresses rather than between abrading passes. This is very important for angle grinding particularly. Moreover this is obtained even though the amount of abrading surface is reduced by provision of the viewing holes. Most significantly however, when the abrading surface of the disk is reduced further by the removal of chord segments, (as in disk A), so as to give improved vision of the surface of the workpiece right up to the edge of the abrading disk, the disk cut more metal, at a lower power draw-down and over a longer period. This is quite unexpected and highly advantageous.

ADVANTAGES

Advantages of preferred forms of this invention include:

1. The user can see through apertures in the spinning tool to accurately grind a desired conformation, or shape;
2. However the apertures principally provide air turbulence across the work surface, assisting in debris removal and in cooling the sanding disk and backing plate, so that the area being abraded remains relatively cool and under its melting point. One test showed a reduction of 114° F. difference on steel.
3. The sanding disk is worn more evenly, and lasts longer. The angle grinder uses less power (as measured by driving it from a limited-capacity petrol generator).
4. There is less tendency for material to clog the abrasive surface. Dust is blown well away from the job.
5. The disk provides a finer and more even finish.
6. The invention is particularly useful in sheet metal work, where the likeliness of the sheet metal becoming distorted due to heat generated during "cleaning-up" of welds or seams or the like by abrasion is low, thanks to the cooling effect of the apertures.
7. The adjustable guard assists in operator protection against a relatively "naked" spinning sanding disk.
8. The manufacturing process allows disks of any shape to be made without expensive dies.
9. More units can be made from the same amount of raw material—typically over 15% more.

One might wonder whether a sanding disk with so much less actual abrasive material than a solid circular one represents value for money. In our experience the disks of this invention last significantly longer before replacement is needed. The cooler operation reduces clogging, keeps the work surface at a lower temperature, and reduces damage to the sanding disk. The wear patterns of our disks are superior, in that wear is more even, so that a disk reaches the end of its life much later. The work is ground down more gradually and over a wider area, so that score marks and the like are less evident.

Finally, it will be appreciated that various alterations and modifications may be made to the shape of the sanding disk and related equipment without departing from the scope of this invention as set forth.

I claim:

1. A circular abrasive disk having a mounting aperture and an abrasive bearing surface, said disk also having at least one non-concentric viewing aperture through the disk in which the shape of the disk is modified by the removal of a peripheral portion at least three spaced locations around the periphery of the disk and wherein the points on the disk between which portions have been removed are connected by a curved edge.

2. An abrasive disk according to claim 1 in which the portions removed are identical and each has the shape of the fraction of an imaginary circle that extends beyond the circumference of the disk, leaving gaps in the periphery of the disk each gap having leading and trailing edges defined by the direction of rotation of the disk.

3. An abrasive disk according to claim 2 in which at least the trailing edge of each gap is modified to provide a gradual transition to the peripheral edge of the circular disk.

4. An abrasive disk according to claim 2 in which non-concentric holes are provided in the body of the disk at spaced locations around the disk.

5. An abrasive disk according to claim 4 having a first series of holes each hole being located adjacent the leading edge of each peripheral gap with the center of each hole lying on a common circle concentric with the abrasive disk.

6. An abrasive disk according to claim 5 in which a second series of holes are provided at spaced locations between the first series of holes with the center of each hole lying on a common circle concentric with the abrasive disk.

7. An abrasive disk according to claim 6 in which the diameter of the circle on which the second series of holes is located is smaller than that of the circle on which the first series of holes is located.

8. An abrasive disk according to claim 1 in which the face of the disk opposite to the abrasive bearing surface is provided with an attachment surface adapted to be attached by a hook and loop system to a backup pad.

9. An abrasive disk according to claim 8 in which a foam layer is interposed between the abrasive bearing surface and the attachment surface.

* * * * *